United States Patent [19]

Wilcox, Jr. et al.

[11] Patent Number: 4,669,560

[45] Date of Patent: Jun. 2, 1987

[54] CONTINUOUS MINING MACHINE

[75] Inventors: Arnold G. Wilcox, Jr., Shady Spring; Roger D. Plumley, Crab Orchard, both of W. Va.

[73] Assignee: Fairchild International, Inc., Beckley, W. Va.

[21] Appl. No.: 806,821

[22] Filed: Dec. 10, 1985

Related U.S. Application Data

[62] Division of Ser. No. 580,706, Feb. 16, 1984, Pat. No. 4,596,424.

[51] Int. Cl.[4] ..... B62D 55/26

[52] U.S. Cl. ..... 180/9.1; 180/9.5; 180/9.52; 280/5 H; 305/10; 305/27

[58] Field of Search ..... 180/9.1, 9.21, 9.5, 180/9.52, 9.54, 9.56, 9.58, 9.6, 9.62, 9.64, 10; 280/5 H; 305/10, 16, 27, 60, 34

[56] References Cited

U.S. PATENT DOCUMENTS

| | | | |
|---|---|---|---|
| 3,095,938 | 7/1963 | Bertelsen | 180/9.52 X |
| 3,096,840 | 7/1963 | Mazzarins | 180/9.5 |
| 3,430,790 | 3/1969 | Beltrami | 180/9.52 X |

FOREIGN PATENT DOCUMENTS

| | | | |
|---|---|---|---|
| 701604 | 3/1966 | Italy | 180/9.52 |

*Primary Examiner*—John J. Love
*Assistant Examiner*—Mitchell J. Hill
*Attorney, Agent, or Firm*—Cushman, Darby & Cushman

[57] ABSTRACT

A continuous mining machine comprising an elongated conveyor assembly for continuously conveying coal cut from a coal seam rearwardly away from the face of the coal seam being cut having a frame structure associated therewith. A power driven cutting assembly is disposed forwardly with respect to the frame structure for cutting coal from the coal seam for conveyance rearwardly by the conveyor assembly. A pair of power driven endless track units is provided for mounting the cutting and conveyor assemblies for movement between a tramming position wherein the assemblies are supported on power driven endless track units in a generally balanced condition for transport within the mine and an operative cutting position wherein the assemblies are moved forwardly in a generally unbalanced condition. Vertically extensible and retractable jacks are carried by the power driven endless track units for extension into mine roof engagement so as to stabilize the units when the cutting assemblies are moved from the tramming position into the operative cutting position. Power operated units are provided for moving the assemblies from the tramming position into the operative cutting position while the vertically extensible and retractable means is extended into mine roof engagement.

3 Claims, 37 Drawing Figures

Fig. 19
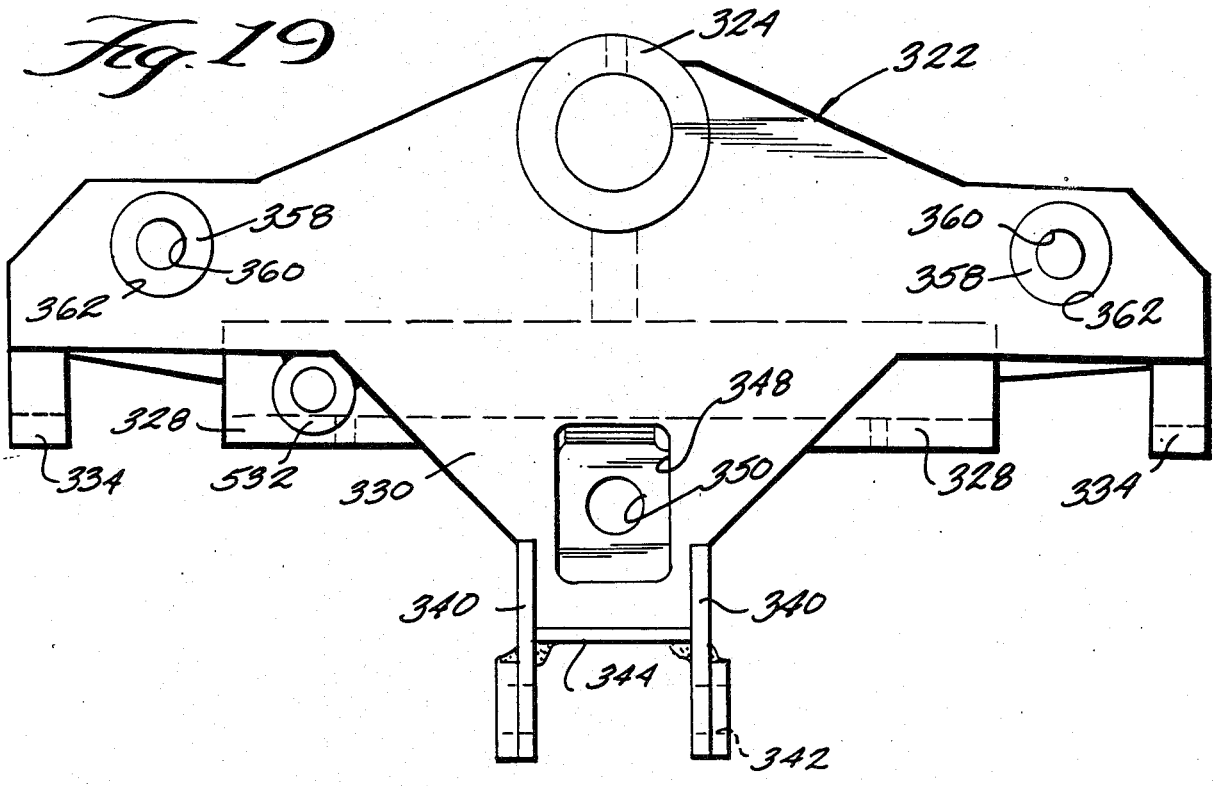
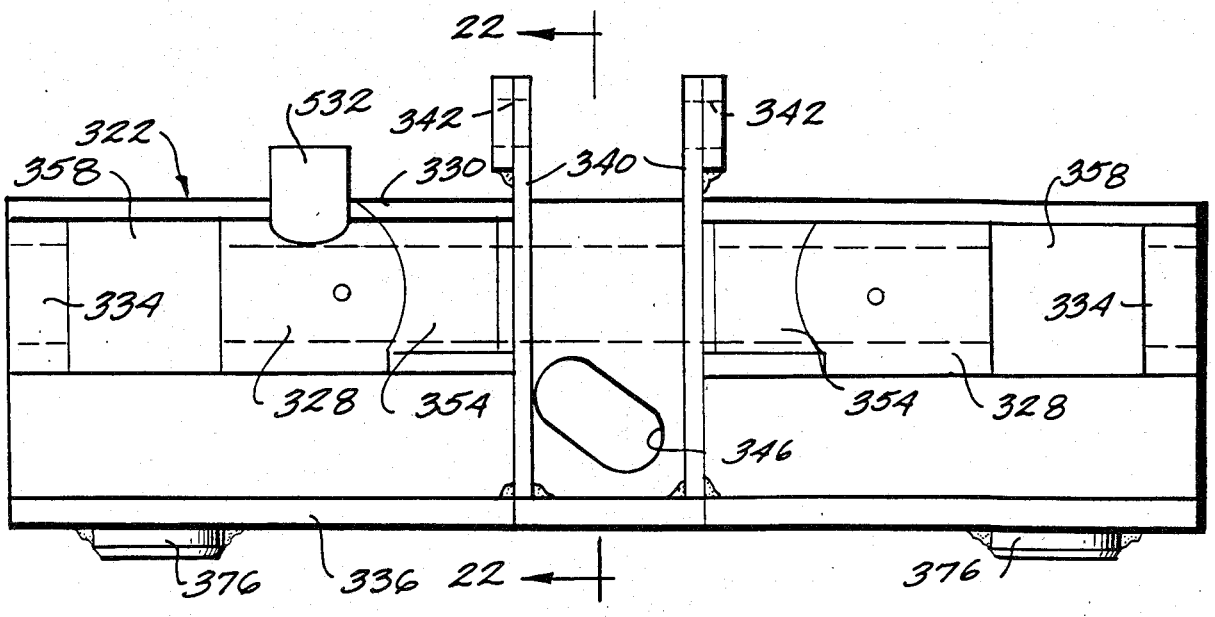
Fig. 20

Fig. 34
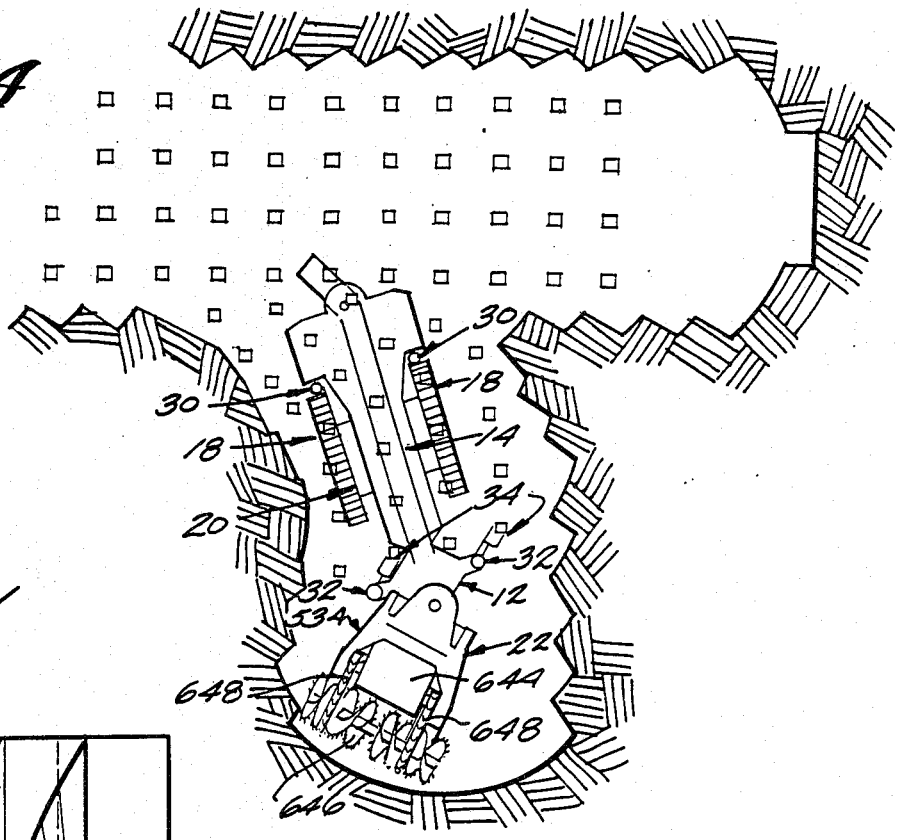
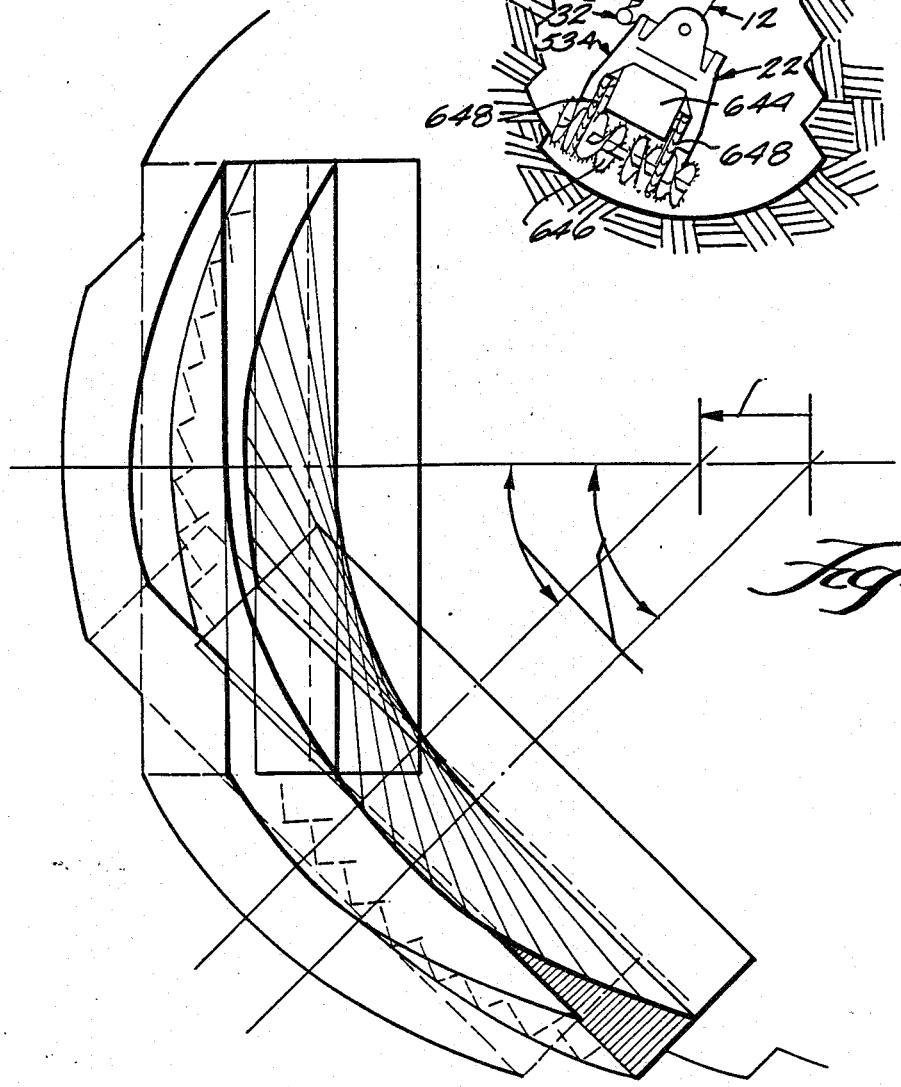
Fig. 35

CONTINUOUS MINING MACHINE

This is a division of application Ser. No. 580,706 filed Feb. 16, 1984 issued June 24,1986 as U.S. Pat. No. 4,596,424.

This invention relates to a continuous mining of coal and other minerals in underground mine conditions and more specifically to improvements in continuous mining machines.

Continuous mining machines have been in popular use since the late 1940's. The term "continuous mining machine" is broad enough to encompass within its meaning so-called long wall continuous mining equipment as well as short wall equipment. The term "long wall" is derived from the extent of the wall or face of the coal which is being cut from the vein. A typical long wall machine will cut across a face which may be from 200 to 300 feet. A typical long wall machine includes a conveyor which is parallel to the face supported on the mine floor adjacent the face and a cutter which moves along the conveyor in cutting engagement with the face so as to remove coal from the solid and deposit it on the conveyor. The long wall equipment also includes a series of roof support assemblies which are capable of advancing as successive cuts are made. The usual long wall system permits progressive collapsing of the roof rearwardly of the roof supporting assemblies. A disadvantage of a long wall operation is the extreme high cost of the equipment. The advantages are that the entire seam of coal along the working face is removed and a substantial amount of coal can be cut in each setting of the machine and very little time is lost in shifting from one setting to another.

All continuous mining machines remove coal from the solid by engaging the solid coal in the seam with a power driven cutting mechanism. In a long wall operation the cutting mechanisms utilized usually are capable of cutting the entire height of the seam in one pass. Consequently, the amount of coal removed from the seam in each pass is equal to the height of the seam times the depth of cut times the length of the face which, as indicated, is quite extensive. In contrast, a short wall mining machine removes coal from the vein along a relatively short span, leaving a perpendicular wall of coal or pillar at the ends of the working face. The pillars serve to prevent collapse of the type normally undertaken in a long wall system and in addition roof support between the pillars must also be provided. Roof support is usually provided by roof bolts or the like which must be separately installed.

The need to form roof supporting pillars as coal removal progresses and the need to provide roof support between the pillars places severe restrictions upon the width of the cut which can be made. With respect to the width of cut, continuous miners operating on the short wall principle provide cutters which are either of the full face type or of the horizontally movable type. Full face cutting mechanisms which cuttingly engage the full height of the seam are known as boring type machines and their cycle of operation is to bore into the face a predetermined distance, then back out and take another cut alongside the first one. Other full face cutting mechanisms do not contact the full height of the seam at any one time but must be moved vertically while in contact with the seam in order to remove the entire height of the seam. See, for example, Wilcox U.S. Pat. No. 3,044,753 dated July 7, 1962. A problem with full face cutting mechanisms is that because the machine and its cutting and conveying mechanism substantially fill the width of the room being cut maneuverability is difficult to achieve and the installations of roof bolts cannot easily be undertaken as an adjunct to the forward movement of the machine into the face.

Commonly-assigned Fairchild U.S. Pat. No. 4,226,476 dated Oct. 7, 1980 discloses a full face machine of the vertically movable type in which provision is made to overcome the problems noted above with respect to installation of roof bolts and the maneuvering of the machine within the mine. In general it can be stated that the full face machines are efficient only in seams which are relatively high. To date, continuous mining machines which have been used in low seams, such as 30" and below, are not of the full face type but rather, of the type in which the cutters are moved laterally across the face. Perhaps the most successful low seam continuous mining machine of this type is the dual auger type embodying two oppositely pitched and oppositely rotated augers, each of which is movable vertically in addition to the lateral movement. See, for example, commonly-assigned Wilcox U.S. Pat. No. 3,026,098 dated Mar. 20, 1962; and U.S. Pat. No. 3,269,776 dated Aug. 30, 1966. While machines of the dual auger type have been successfully utilized in low seams they have not been successfully utilized in high seam operation. The only machines that have been utilized to any extent in both high and low seams are the so-called universal cutter machines which embody a single cutting head which is capable of being moved both horizontally and vertically. See, for example, U.S. Pat. No. 3,437,382 dated Apr. 8, 1969. While machines of the universal cutter type have proven to be operable in both high and low seams, their efficiency quite clearly falls off as the height of the seam increases since the amount of coal which can be engaged by one cutter cannot exceed a predetermined maximum. Moreover, in low seams a single universal cutter is not as efficient as the twin cutters of a dual auger machine. Nevertheless, there is clearly an advantage in being able to provide a single machine which is capable of efficient operation not only in low seams but in high seams as well.

One of the objectives of the present invention is to provide a machine which is capable of operating in both low seams and higher seams efficiently. In accordance with the principles of the present invention, this objective is obtained by providing the continuous mining machine with a dual auger type cutting mechanism which in low seam operation functions in the normally efficient manner of conventional dual auger low seam continuous mining machines, the mount for the cutting heads being such as to enable the cutters to be moved and operated in a high seam mode with the axes of the cutters extending vertically as distinguished from the normal horizontal extent of the axes in normal low seam operation. Moreover, the arrangement is such that the cutters can be operated while being moved between a position wherein the axes extend vertically and the axes extend horizontally In addition to the above, it is an object of the present invention to provide a continuous mining machine which more effectively and efficiently deals with the two problems referred to above; namely, (1) maneuverability within the mine, and (2) installation of roof support elements as the mining machine advances. With respect to maneuverability, in U.S. Pat. No. 4,226,476, because the cutting mechanism provided is a full face cutting mechanism, tramming maneuverability of the machine within the underground mine was accomplished by pivoting the normally inline sections of the full face cutting mechanism into a collapsed parallel relation. Separate vertically movable endless track assemblies were provided for supporting the cutting head end of the machine for tramming movement within the mine. Of course, this arrangement materially increased the costs involved. These endless tracks were not usable in operative coal producing maneuvers and for that purpose there is additionally provided hydraulic cylinders mounted to push off against jack mechanisms anchored between the roof and floor of the underground mine. The arrangement enabled the machine to be advanced through a 90° turn. Moreover, these jack mechanisms have embodied therein mechanisms for facilitating the installation of mine roof bolts during the advance of the machine.

This mode of advancement and the attendant roof bolting facility incident thereto have been applied to mining machines of the type embodying laterally movable dual auger cutters. See, for example, U.S. Pat. No. 4,199,193 dated Apr. 22, 1980. The machine of the patent, however, is not provided with a tramming capability and its maneuverability is very limited because the conveyor frame which serves to mount the auger cutters for lateral movement across the seam is almost as wide as the width of the cut.

It has long been recognized that the greatest amount of maneuverability is provided by mounting the components of the continuous mining machine on endless track assemblies and providing a horizontally movable type of coal cutting and conveying mechanism which is moved horizontally by a horizontal swinging movement about a generally upright pivotal axis. The patented literature contains suggestions of mounting dual auger type cutter and conveying mechanisms in this fashion. See, for example, commonly-assigned Wilcox U.S. Pat. No. 2,967,701 dated Jan. 10, 1961 (FIGS. 12–15). See also U.S. Pat. No. 2,920,879 dated Jan. 10, 1961 and U.S. Pat. No. 2,986,385 dated May 30, 1961. A recent commercial embodiment of such a machine is disclosed in commonly-assigned Wilcox U.S. Pat. No. 4,341,424 dated July 27, 1982. While the overall width of these machines is considerably less than the width of the room being cut in the underground mine, nevertheless the width is such as to preclude facilitating the mounting of roof bolts in the roof as mining progresses.

In accordance with the principles of the present invention, the objective of successfully dealing both with maneuverability and mine roof bolt installation during operation is accomplished first by utilizing power operated endless track assembly that is related to the remaining components of the machine such that they are mounted for movement between two different positions. In a first of these two positions, the remaining components of the machine are carried in a balanced forwardly and rearwardly extending relation with respect thereto such that the endless track assembly can be readily operated to relatively rapidly tram the machine into any desired position of operation. The other of the two positions is used during each working cycle of the machine. More specifically, the commencement of each working cycle includes an advancing movement of the power operated cutting and conveying mechanism into the coal seam which is accomplished by means of a pair of hydraulic rams acting against the stationarily positioned endless track assembly to move the main conveyor assembly of the machine forwardly together with the cutting and conveying mechanism extending forwardly thereof. The frame structure of the main conveyor assembly, which is moved forwardly of the endless track assembly and carries with it the cutting and conveying mechanism forwardly thereof, changes the first position balanced condition that the components are supported on the endless track assembly when in the tramming position. To accommodate this change in balance, a pair of hydraulic jacks are provided on the rearward end portion of the endless track assembly for extension into engagement with the mine roof. In addition, the rigid frame structure at the forward end of the conveyor assembly is provided with floor to roof jacks which serve to firmly anchor the same in its unbalanced forwardly extending position. With the cutting and conveying mechanism thus initially positioned within the seam, further coal removal from the seam transversely beyond the initial penetration can be accomplished by moving the cutting and conveying mechanism with respect to the anchored conveyor assembly frame structure laterally, as by horizontal swinging movements and/or vertical movements. Conveniently, roof bolting can be accomplished simultaneously with these cutting movements within the space immediately rearwardly of the moving cutting and conveying mechanism. Since this space is occupied at that time solely by the relatively narrow forward end portion of the conveyor assembly frame structure (rather than the relatively wide endless track assembly which is spaced rearwardly) the installation of mine roof bolts can take place in closely spaced relation with respect to one another (approximately 4 feet) within close proximity (approximately 12 feet) to the mine face being cut during the cutting operation. Preferably the installation of the mine roof bolts is accomplished by a pair of roof bolt installing mechanisms swingably carried by the anchored rigid frame structure on opposite sides thereof for pivotal movement of each into two bolt installing positions.

Preferably, the roof bolt installing mechanisms include provision for temporary roof support while the bolts are being installed. This temporary roof support is supplemented by the adjacent roof engaging jacks at the forward end of the rigid frame structure so that the bolter is not required to work in areas in which the roof overhead is not adequately supported. Moreover, the temporary roof support which insures this condition can be set up from a safe remote position.

The four roof engaging jacks, two on the rearward end portion of the endless track assembly and two on the forward end portion of the frame structure of the conveyor assembly provide the continuous mining machine of the present invention with a stability which is particularly advantageous when pitches are encountered in the mine seam. Pitches or variations in the level of the seam are frequently encountered both in the direction of advance as well as side to side. In addition to the stability of the present machine in operation, the arrangement of components is favorable in moving along such pitches as well. It is preferable in accordance with the principles of the present invention to make the endless track assembly adjustable so as to insure an even greater amount of maneuverability.

Accordingly, it is a further object of the present invention to provide an endless track assembly for use in transporting mining equipment which meets these desirable maneuverability requirements. In accordance with the principles of the present invention, this objective is achieved by providing an endless track assembly which includes a pair of separate side-by-side power operated endless track units, a central carriage structure, and a pair of mounting arm assemblies extending transversely outwardly from each side of the carriage structure. The transversely outwardly extending end portion of each mounting arm assembly is connected to the frame of the associated endless track unit for pivotal movement about a longitudinally extending generally horizontal axis disposed within a vertical plane passing through the width of the endless track unit. The The transversely inwardly extending end portion of each mounting arm assembly is connected with the carriage structure for pivotal movement about a longitudinally extending horizontal axis parallel to the other pivotal axis thereof. Hydraulic rams are provided for independently effecting pivotal movements of each mounting arm assembly. In this way side-to-side slope changes can be readily accommodated by varying the relative vertical positions of the units and front-to-back slope changes can likewise be accommodated by effectively raising and lowering the operating level of the conveyor assembly carried by the carriage structure of the endless track assembly.

Another object of the present invention is the provision of an improved gathering conveyor assembly for a swingable type cutting head which occupies a relatively small space and yet accommodates a relatively large carrying capacity. In accordance with the principles of the present invention, this objective is achieved by providing a gathering conveyor assembly which includes an apertured discharge pan section carried by a yoke structure disposed in an elevated position above the forward end of the elongated conveyor assembly of the machine for horizontal swinging movement with the yoke structure and a U-shaped pan section mounted on the yoke structure for horizontal swinging movement therewith and for vertical swinging movement with respect thereto. The U-shaped pan section is oriented with the free ends of its legs aligned horizontally in spaced side-by-side relation with respect to the discharge pan section. The legs of the U-shaped pan section extend downwardly and forwardly in outwardly diverging relation with the bight portion thereof disposed generally horizontally in a position below the rearward ends of said cutter. A power driven endless scraper chain assembly is mounted for movement along the U-shaped pan section and the discharge pan section in either direction. A hydraulic ram is connected between the yoke structure and U-shaped pan section for effecting vertical swinging movements of the latter with respect to the former.

Another object of the present invention is the provision vision of a continuous mining machine which is simple in construction, effective in operation and economical to manufacture and maintain.

These and other objects of the present invention will become more apparent during the course of the following detailed description and appended claims.

The invention may best be understood with reference to the accompanying drawings, wherein an illustrative embodiment is shown.

Figure 1:
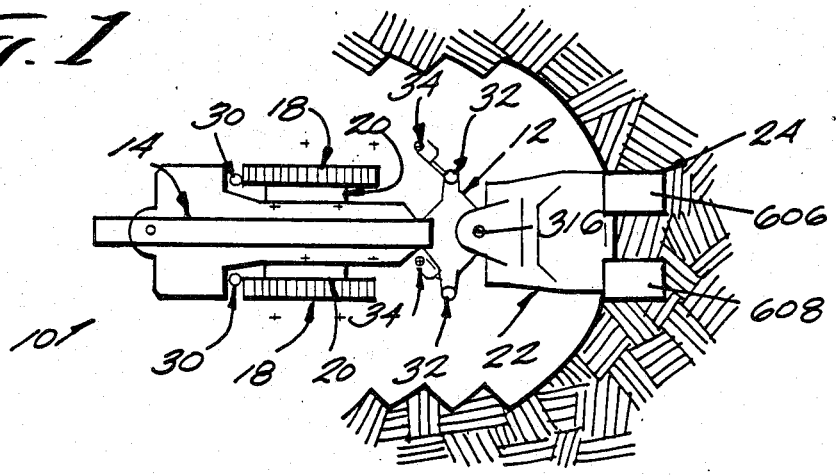
FIG. 1 is a top plan generally diagrammatical view of a continuous mining machine embodying the principles of the present invention illustrating the position of the same after the cutting mechanism has been advanced or sumped into the mine face.
Figure 4A:
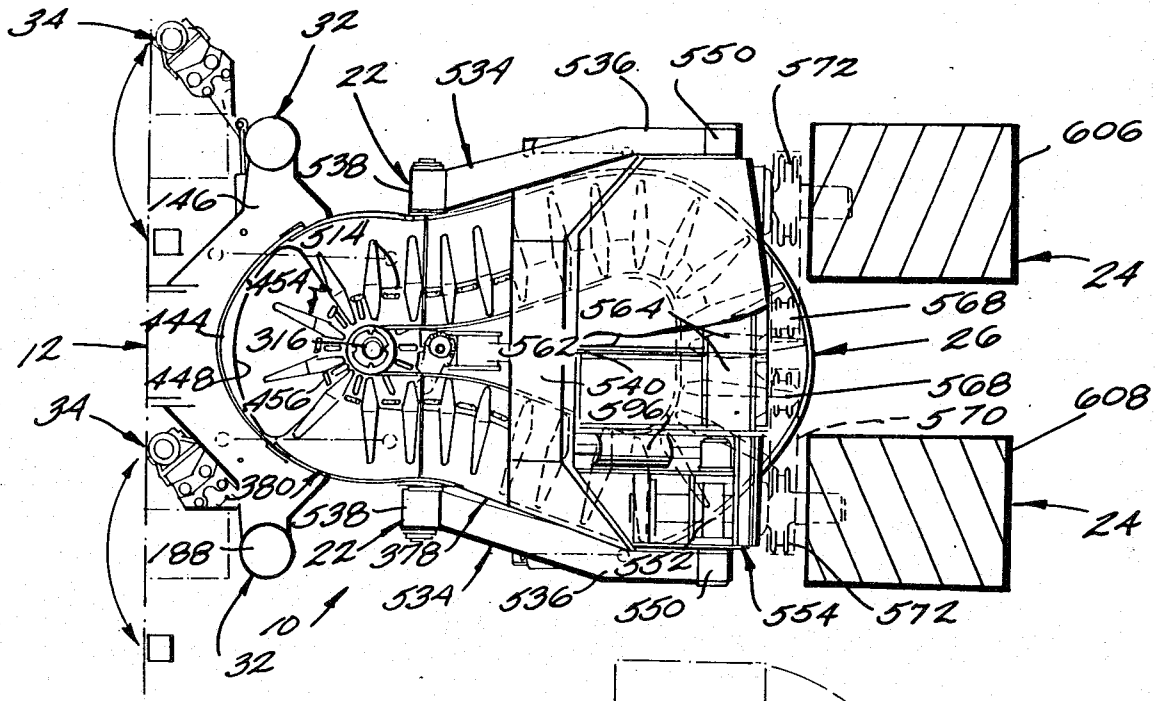
Figure 5A:
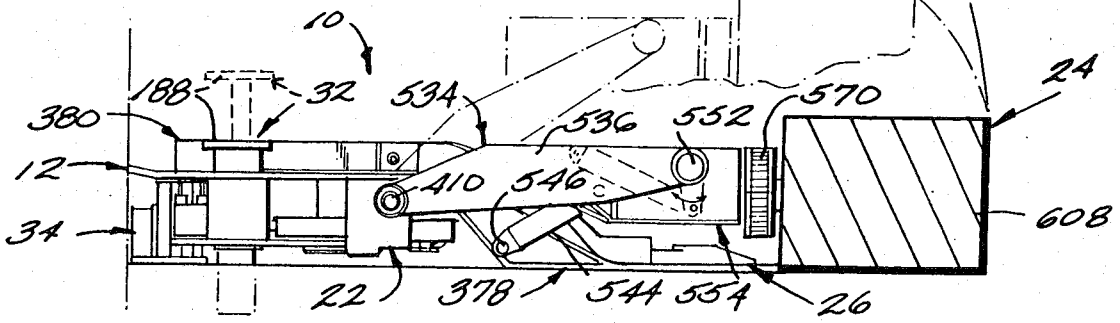
Figure 4B:
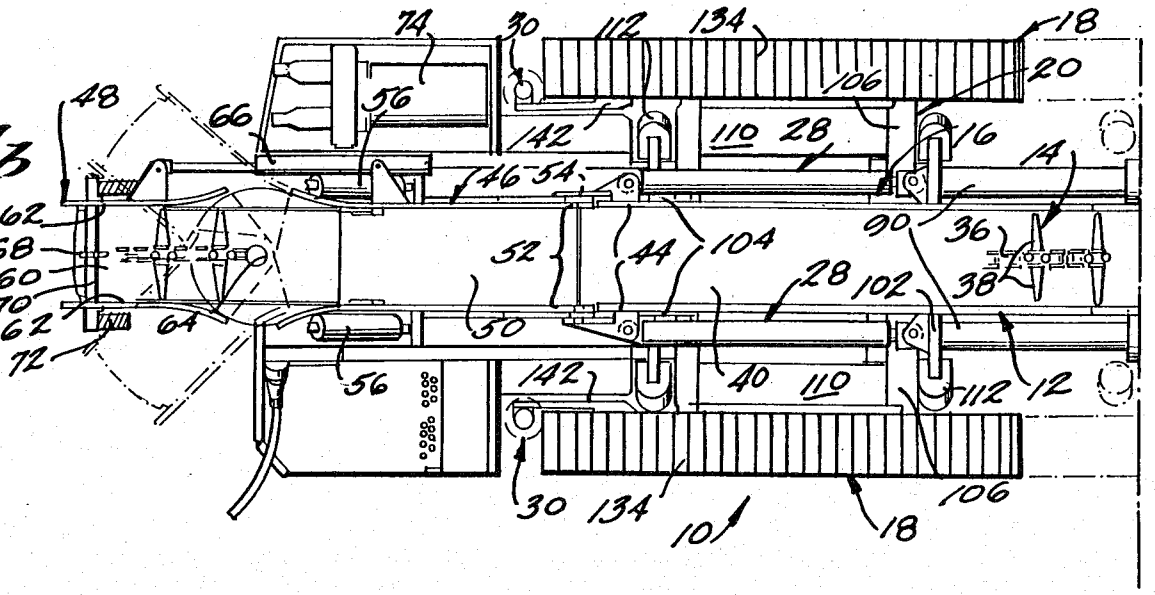
Figure 5B:
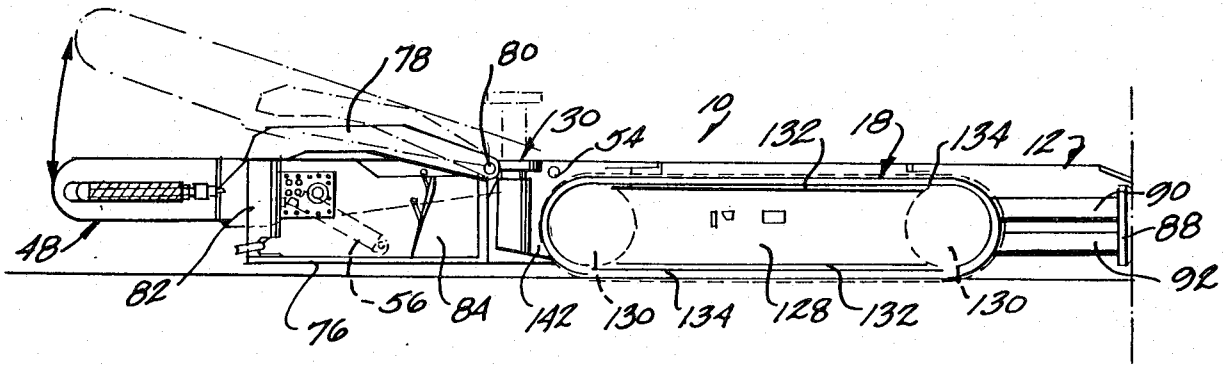

FIG. 4*a* is an enlarged top plan view of the machine shown in FIG. 1 showing the forward portion thereof;

FIG. 4*b* is an enlarged top plan view of the machine shown in FIG. 1 showing the rearward portion thereof;

FIG. 5*a* is a side elevational view of the forward portion of the machine shown in FIG. 4;

FIG. 5*b* is a side elevational view of the rearward portion of the machine shown in FIG. 4*b;*

Figure 6:
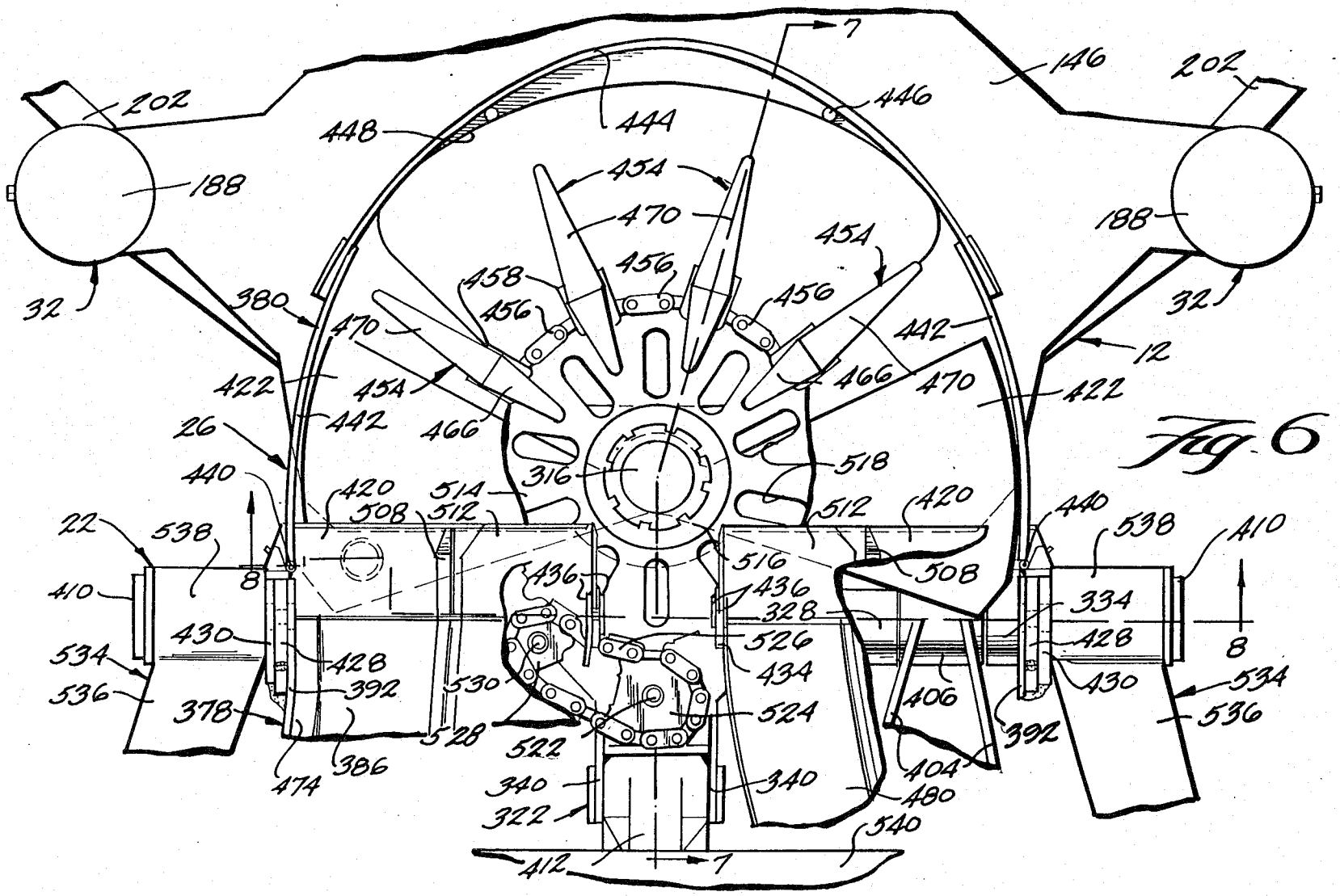
Figure 7:
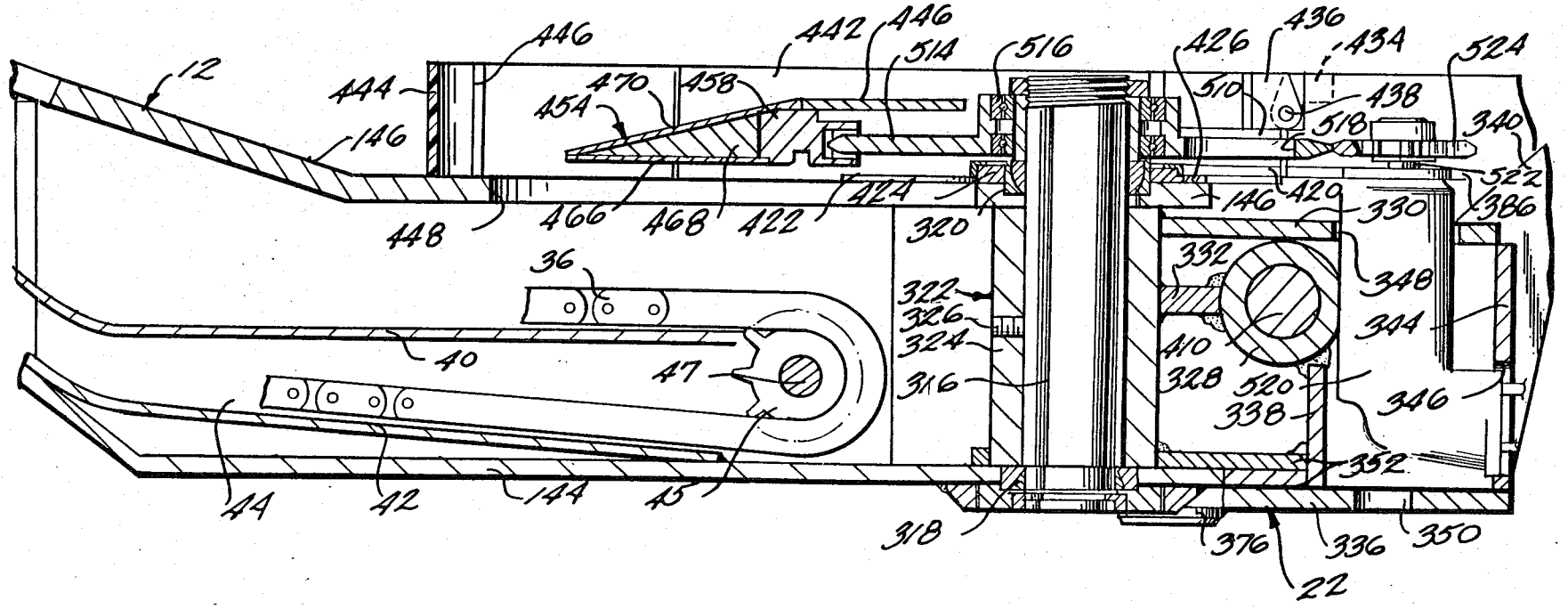
Figure 8:
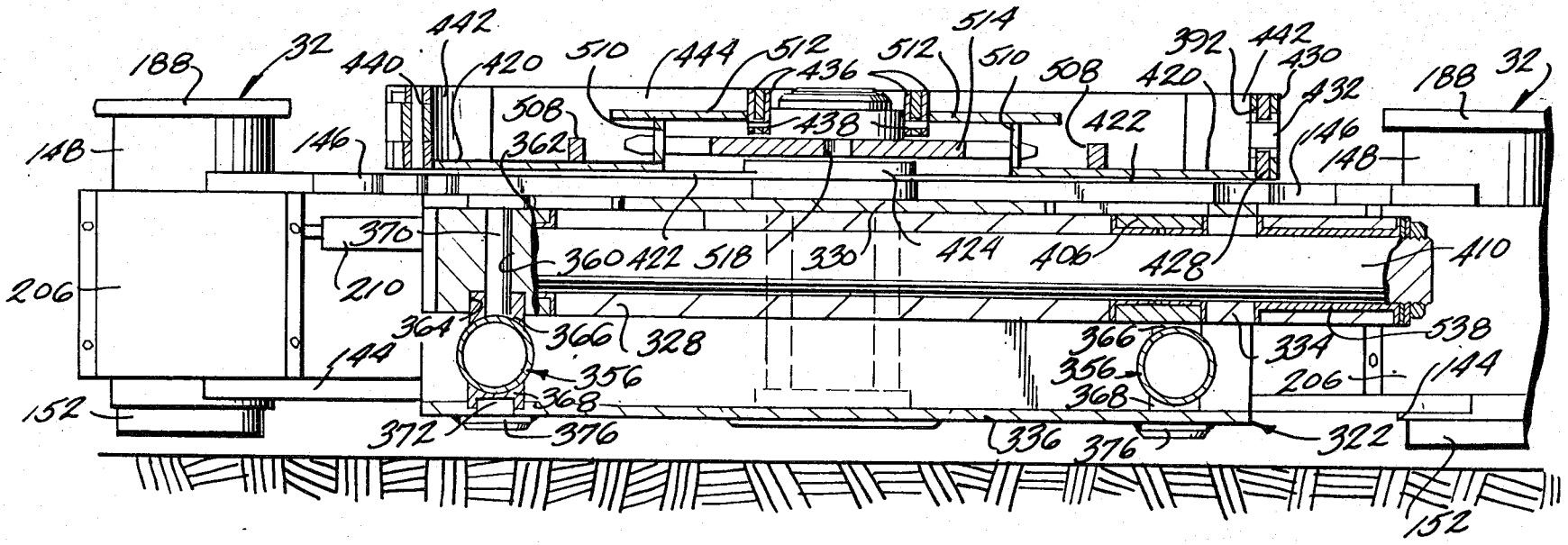
Figure 9:
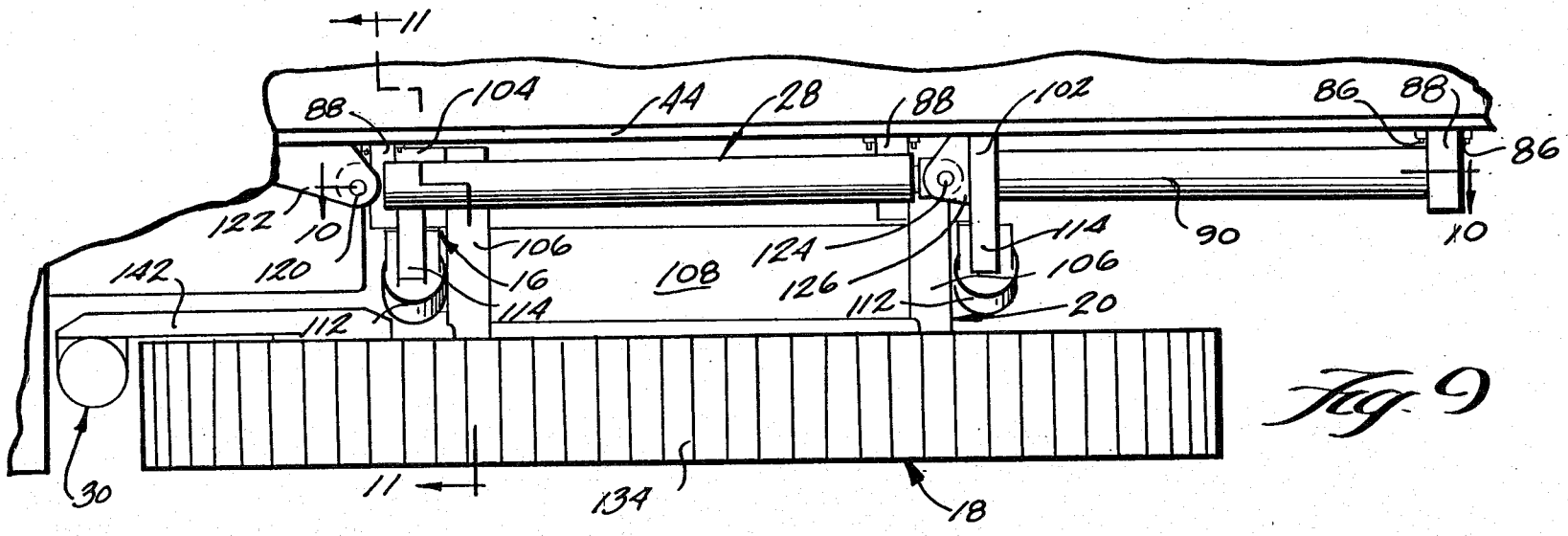
Figure 10:
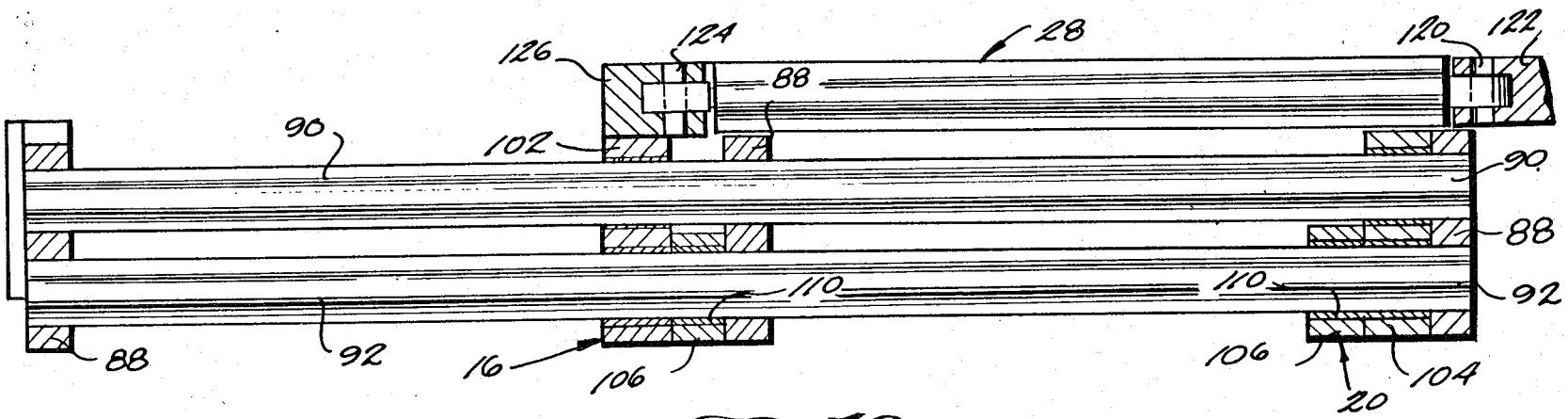
Figure 11:
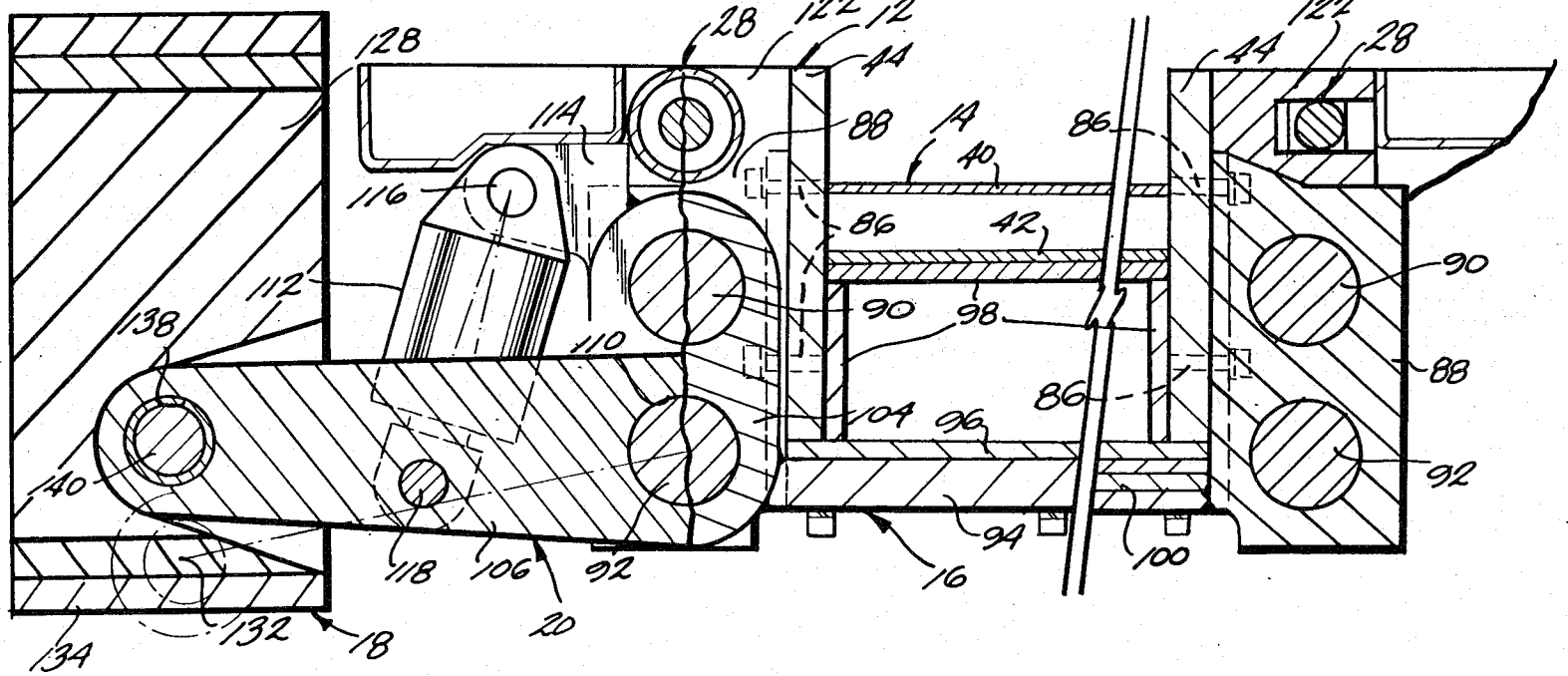

FIG. 6 is an enlarged fragmentary top plan view with parts broken away of the portion of the machine where the rigid frame structure is connected with the movable frame structure;

FIG. 7 is an enlarged fragmentary sectional view taken along the line 7—7 of FIG. 6;

FIG. 8 is an enlarged fragmentary sectional view taken along the line 8—8 of FIG. 6;

FIG. 9 is a fragmentary top plan view showing the connection between the rigid conveyor frame structure and the right-hand endless track assembly of the machine;

FIG. 10 is an enlarged fragmentary sectional view taken along the line 10—10 of FIG. 9;

FIG. 11 is a sectional view taken along the line 11—11 of FIG. 9.

Figure 2:
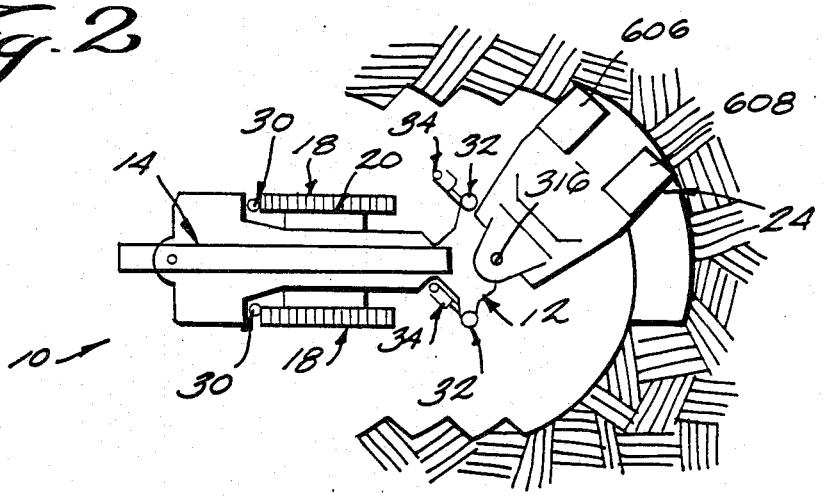
FIG. 2 is a view similar to FIG. 1 showing the position of the cutting mechanism of the continuous mining in an intermediate stage in the mining cycle after the sumping operation.
Figure 12:
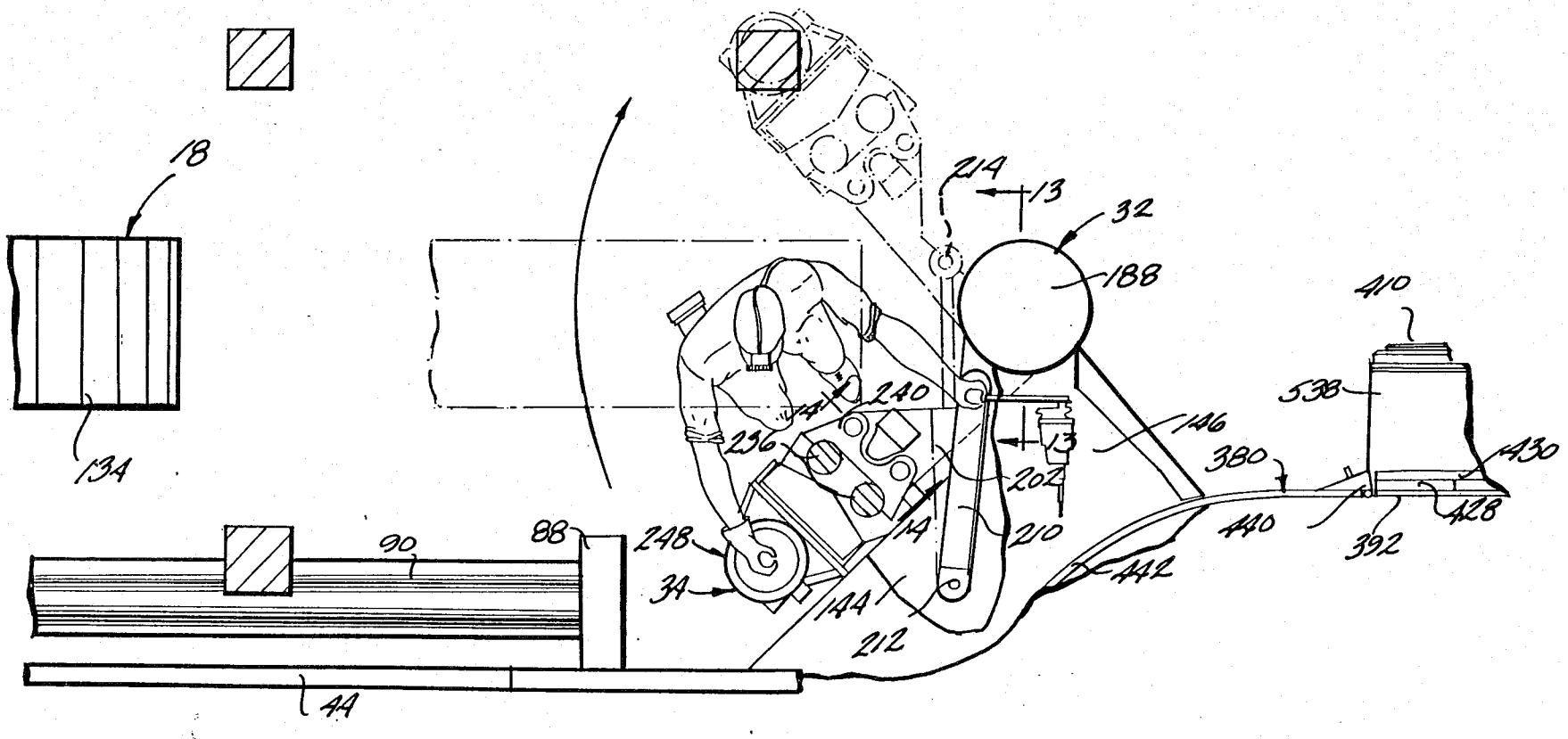
Figure 13:
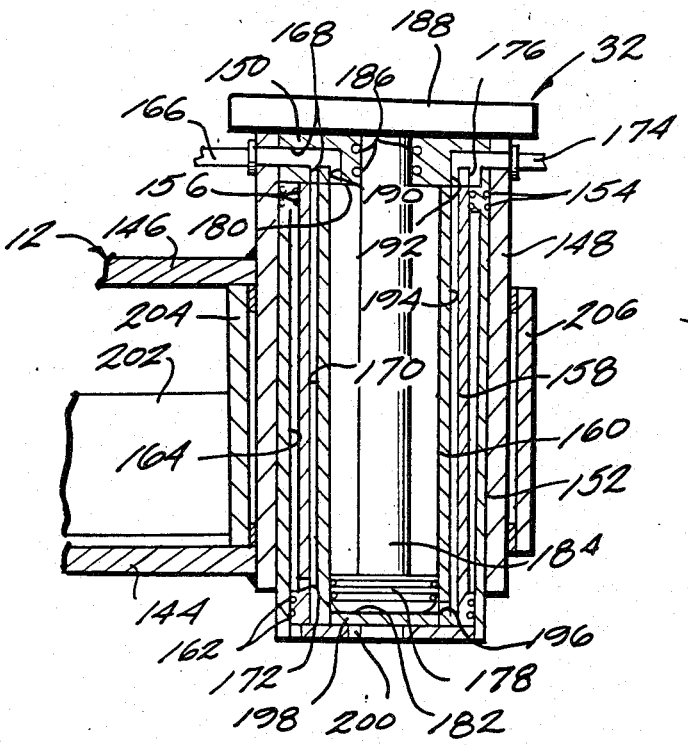
Figure 14:
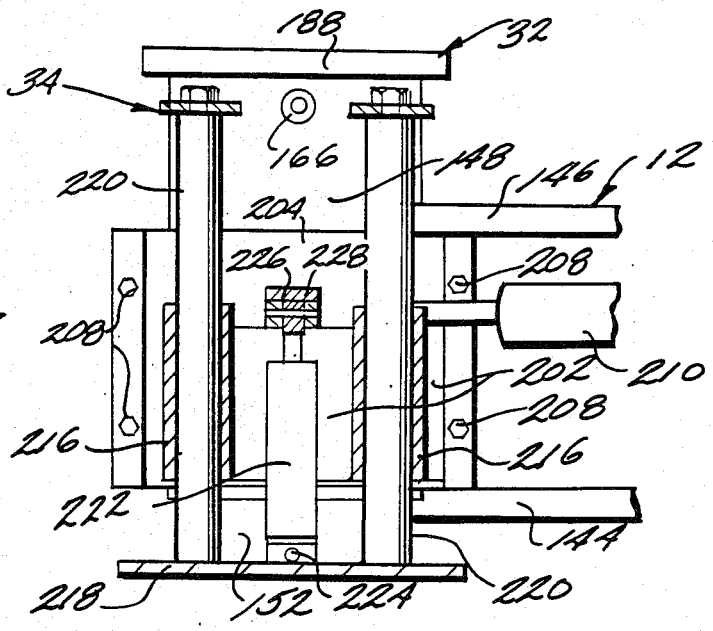
Figure 15:
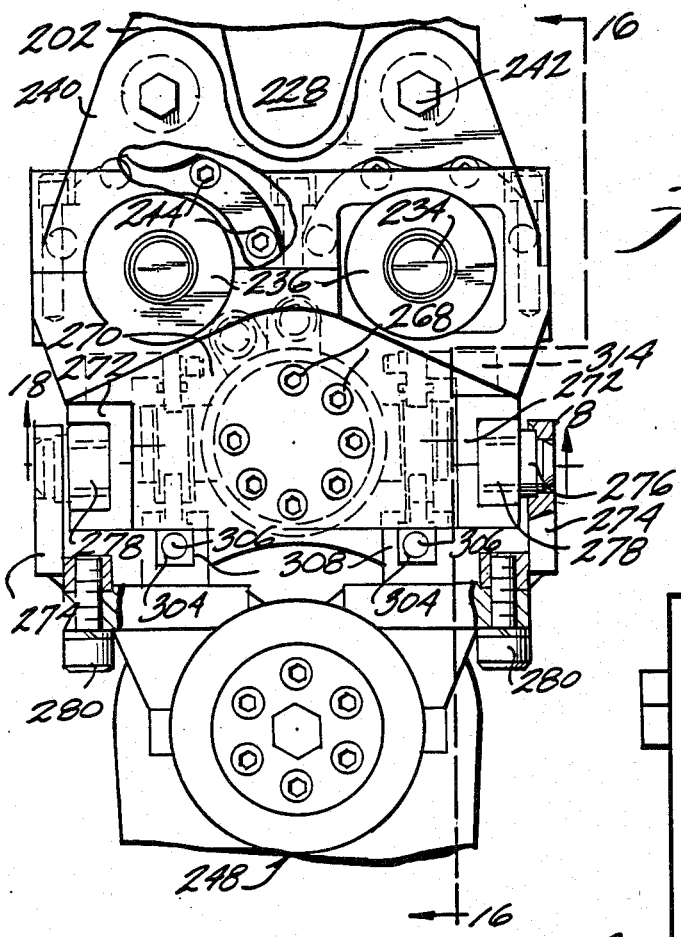
Figure 18:
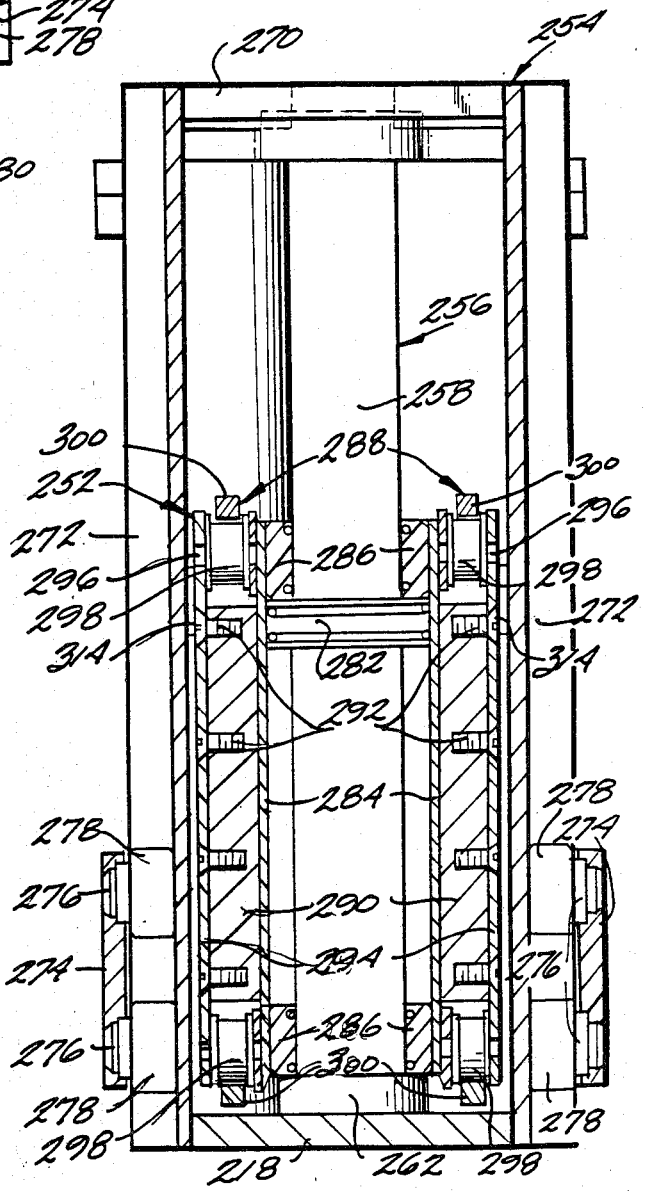
Figure 16:
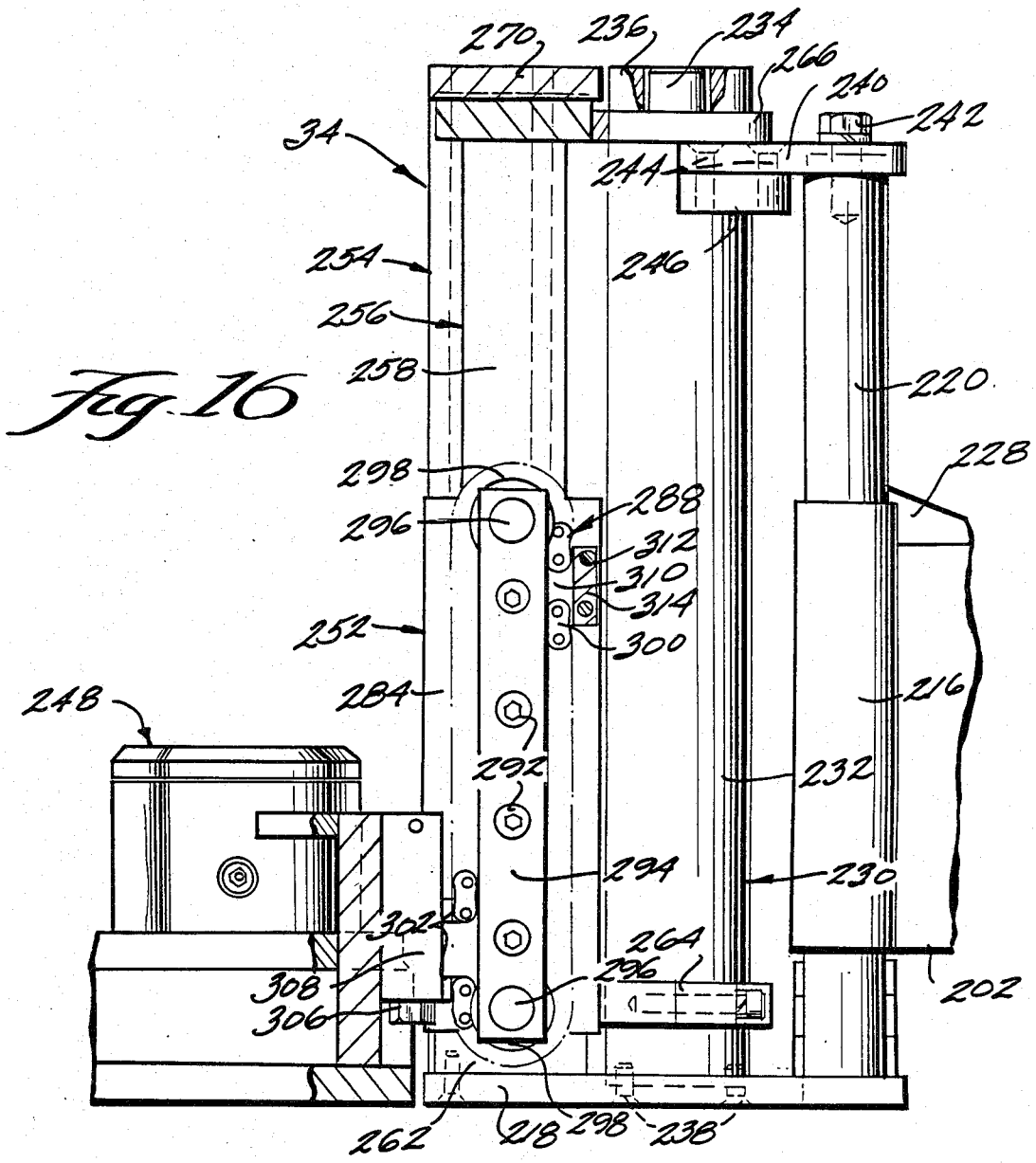
Figure 17:
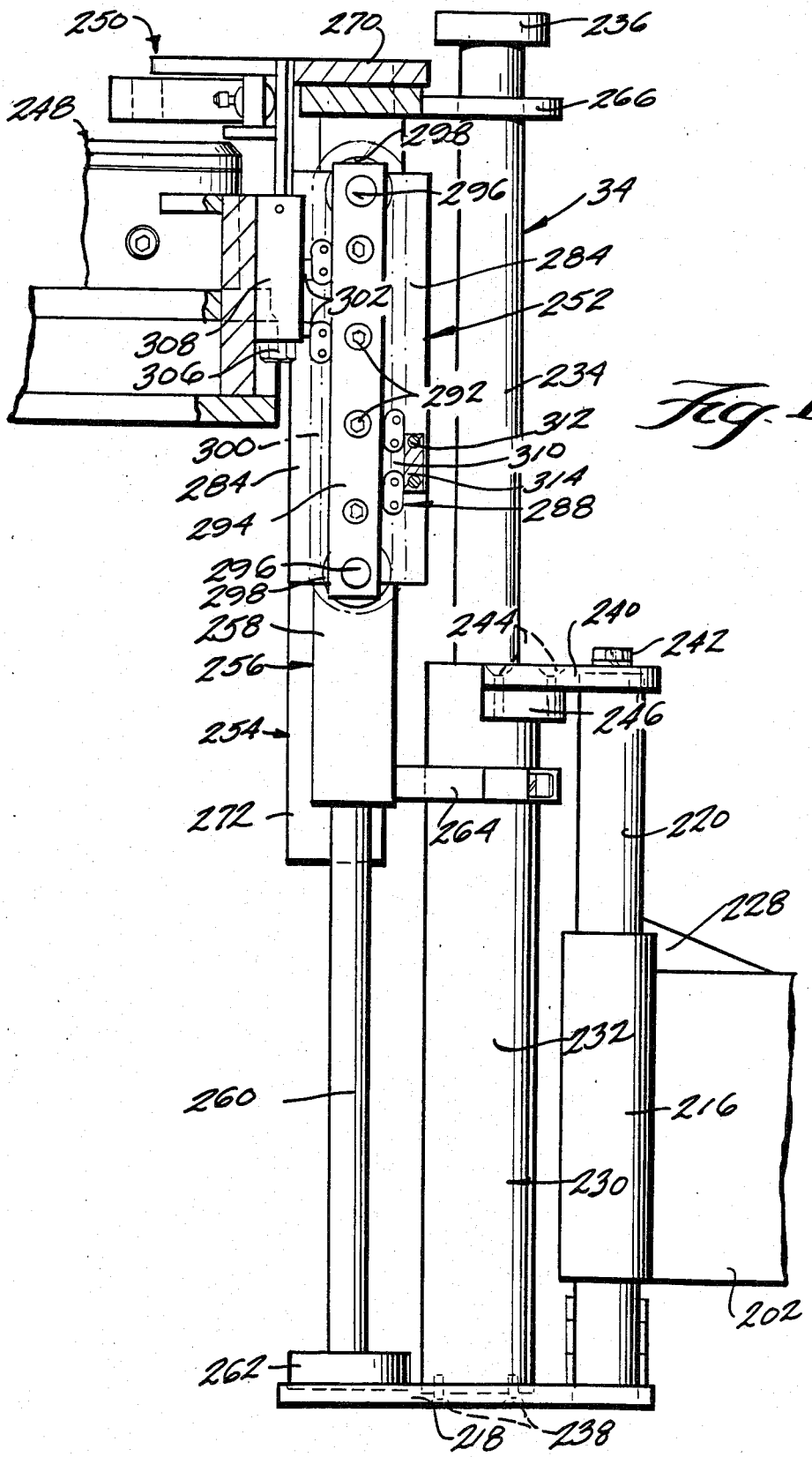
Figure 22:
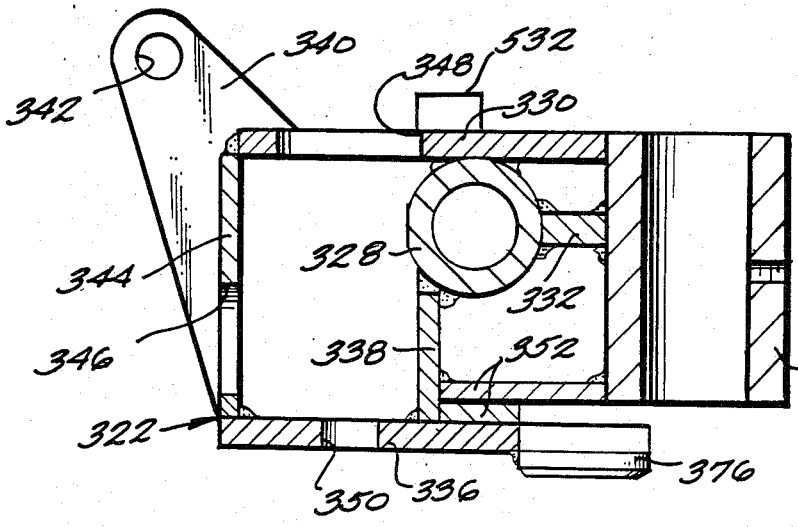
Figure 24:
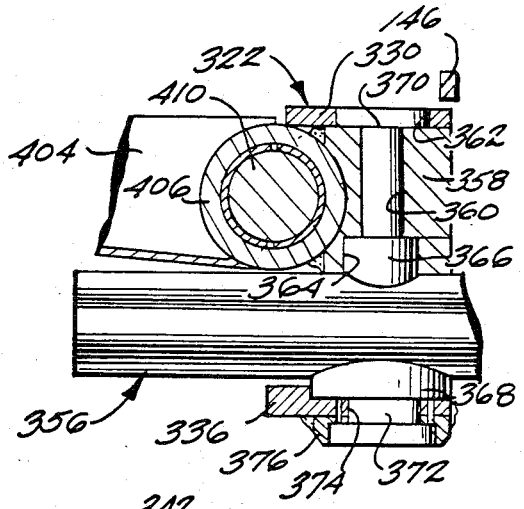
Figure 21:
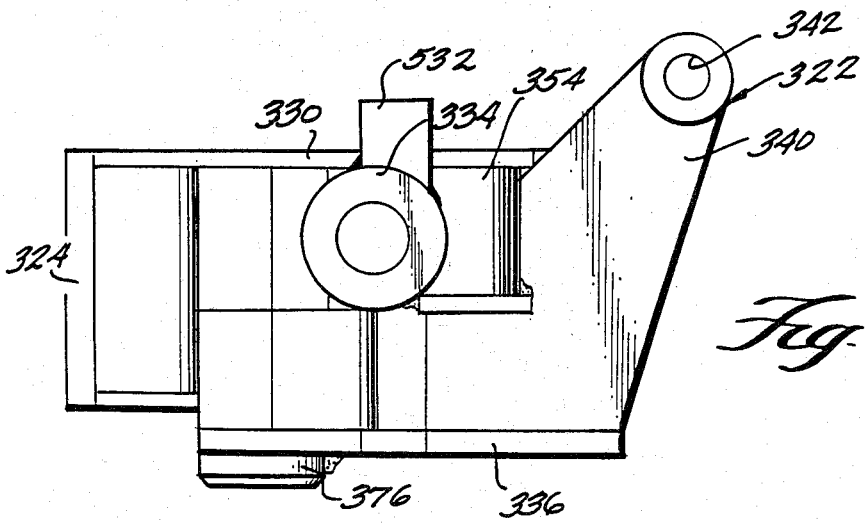
Figure 23:
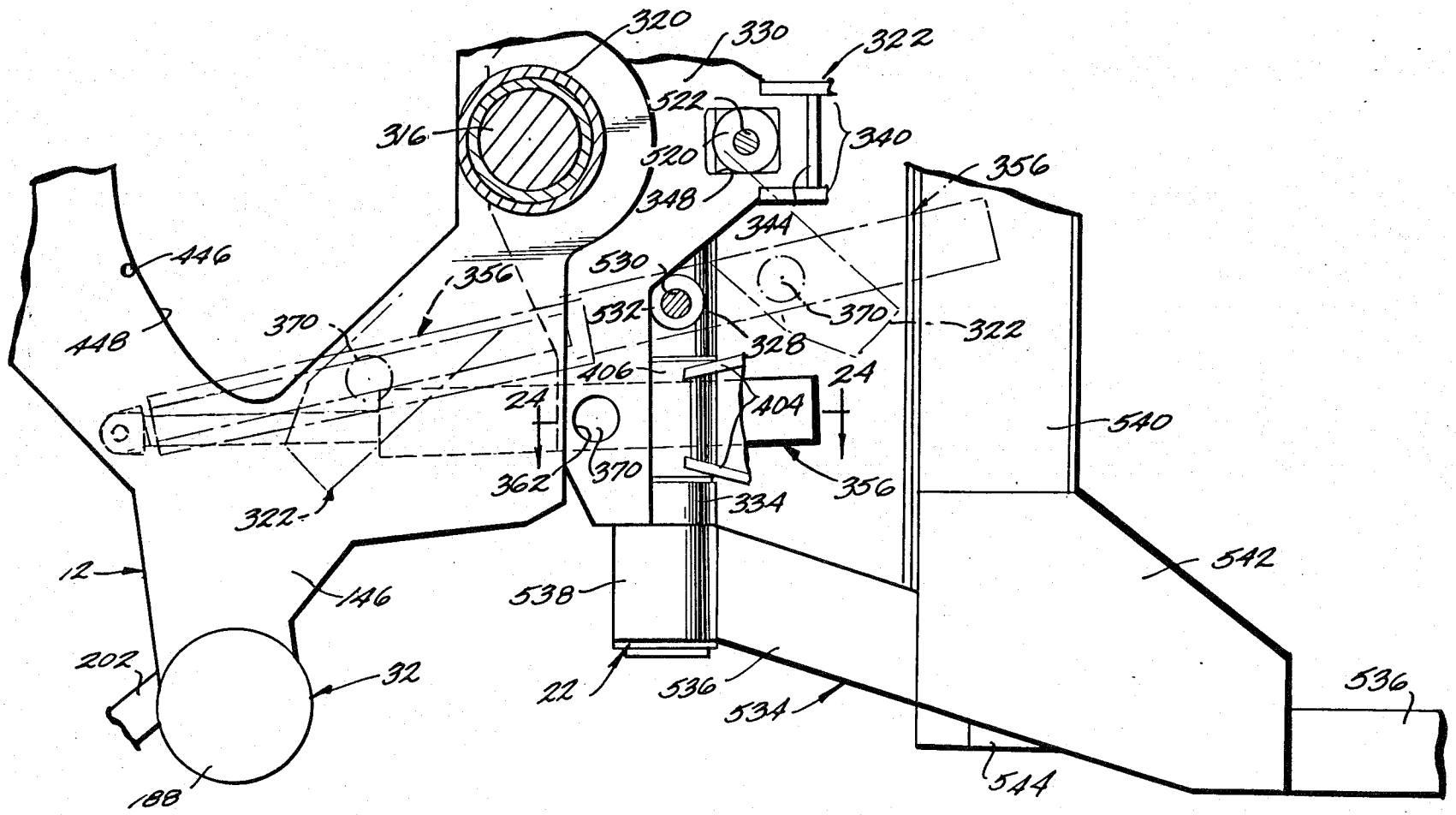
Figure 25:
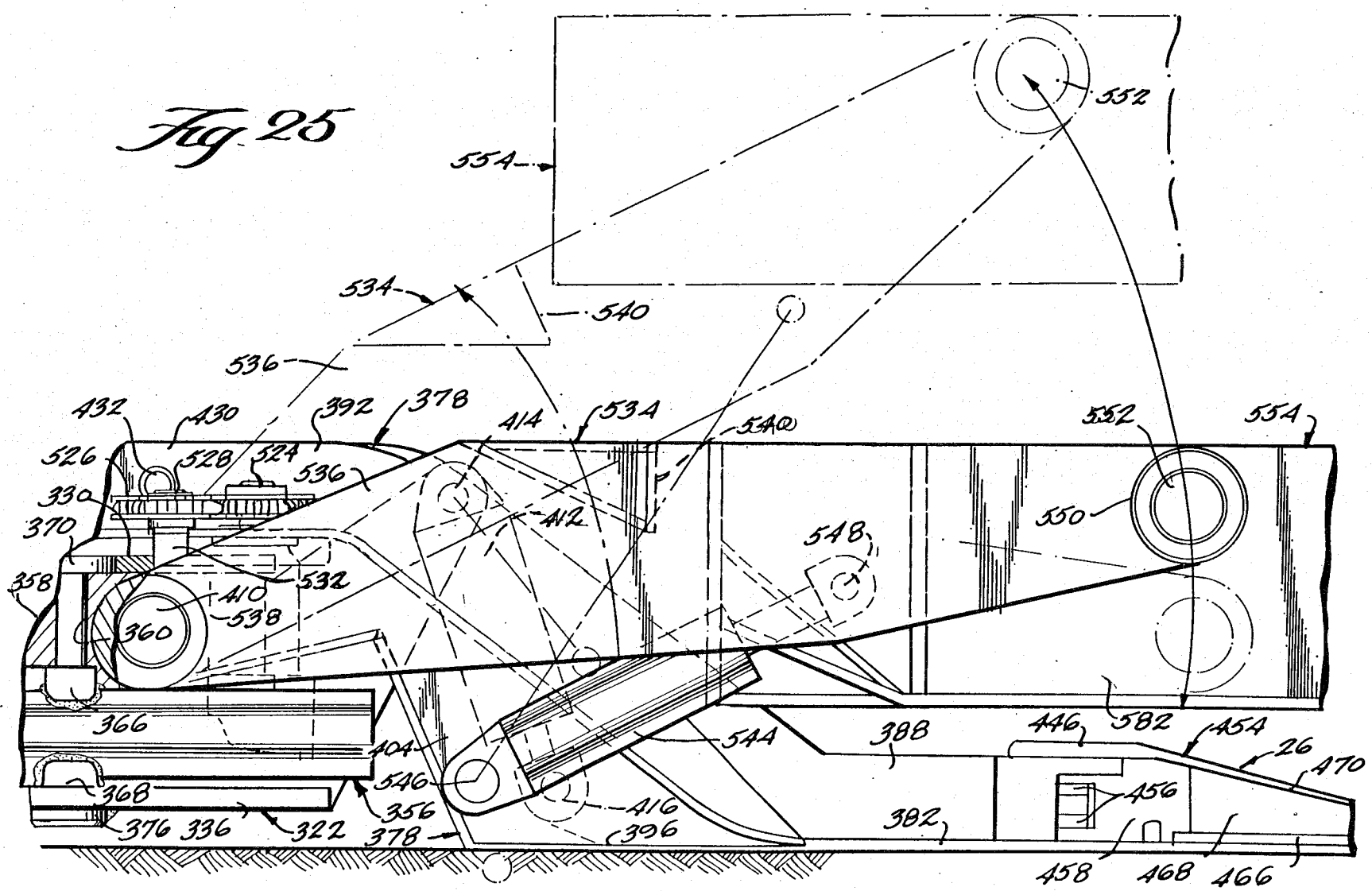
Figure 26:
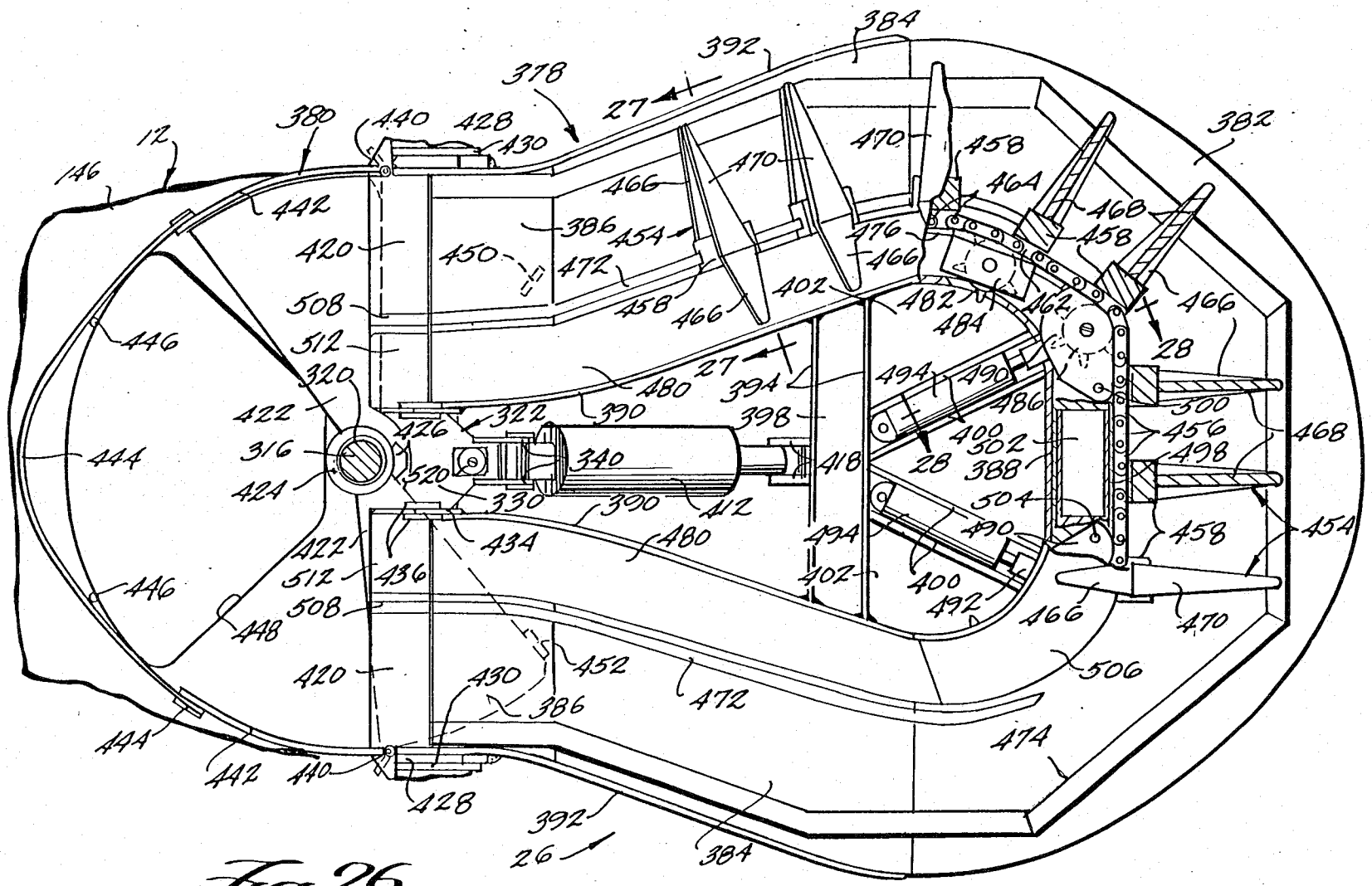
Figure 27:
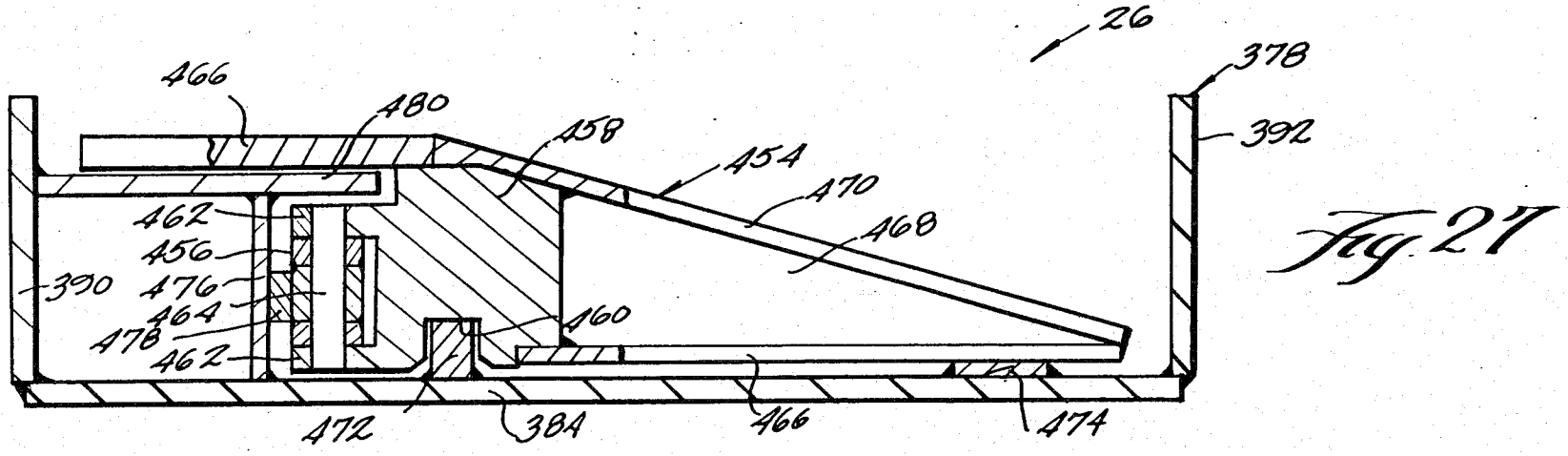
Figure 28:
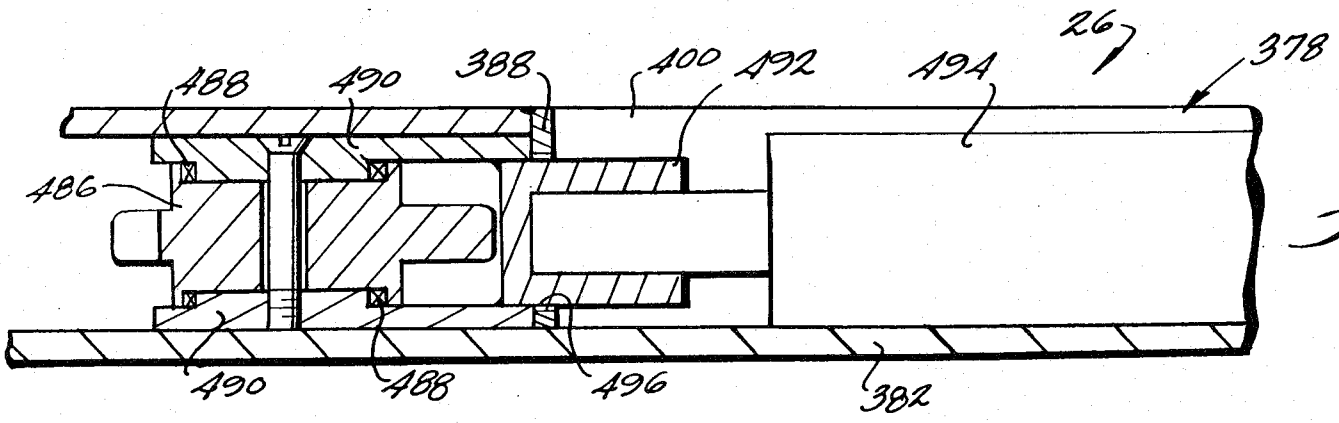
Figure 30:
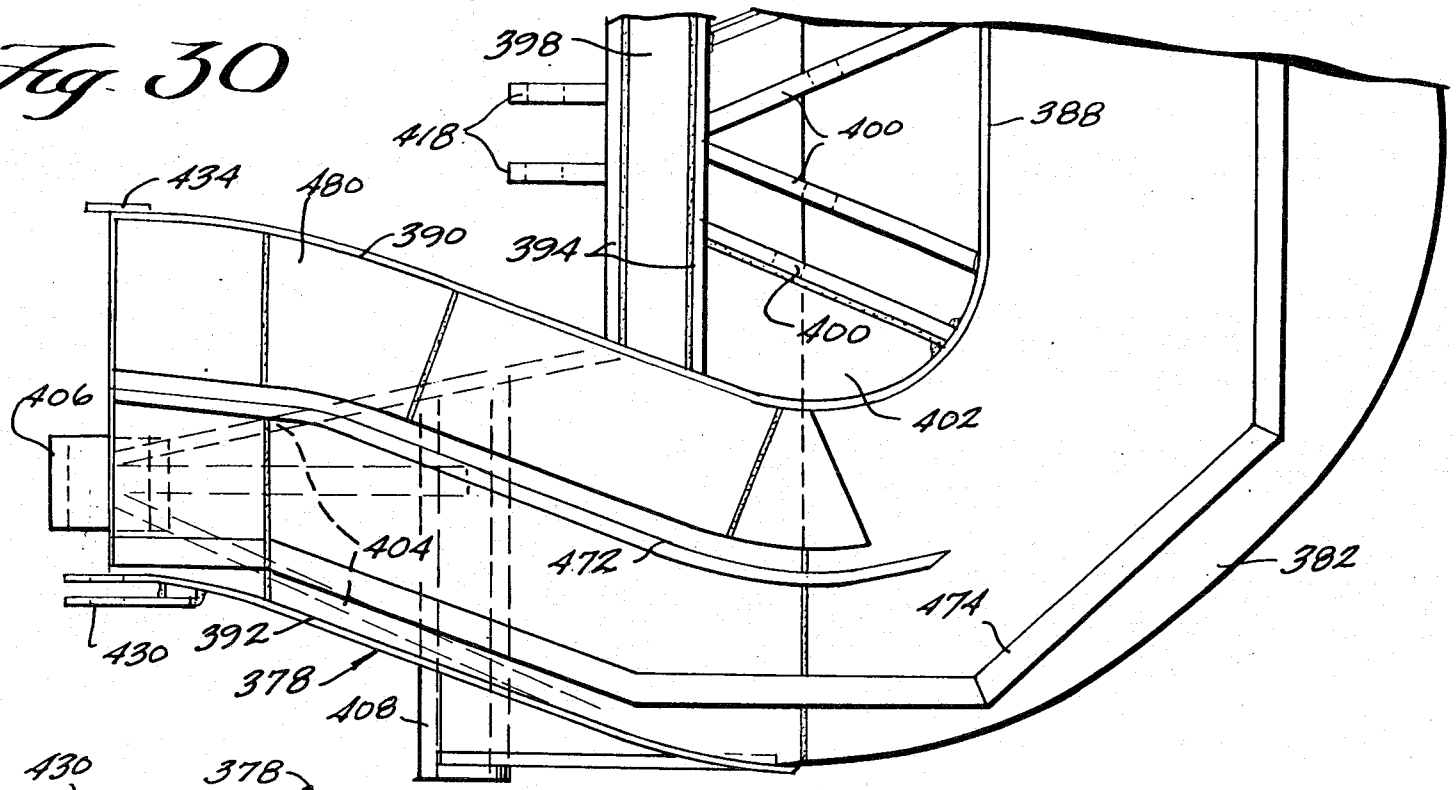
Figure 29:
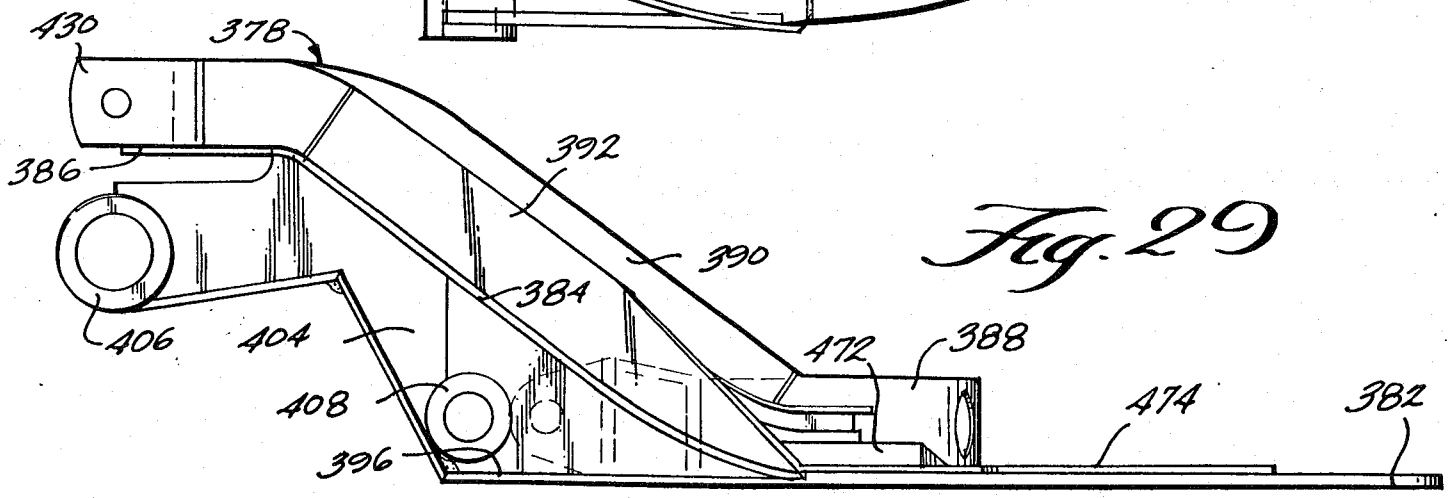
Figure 31:
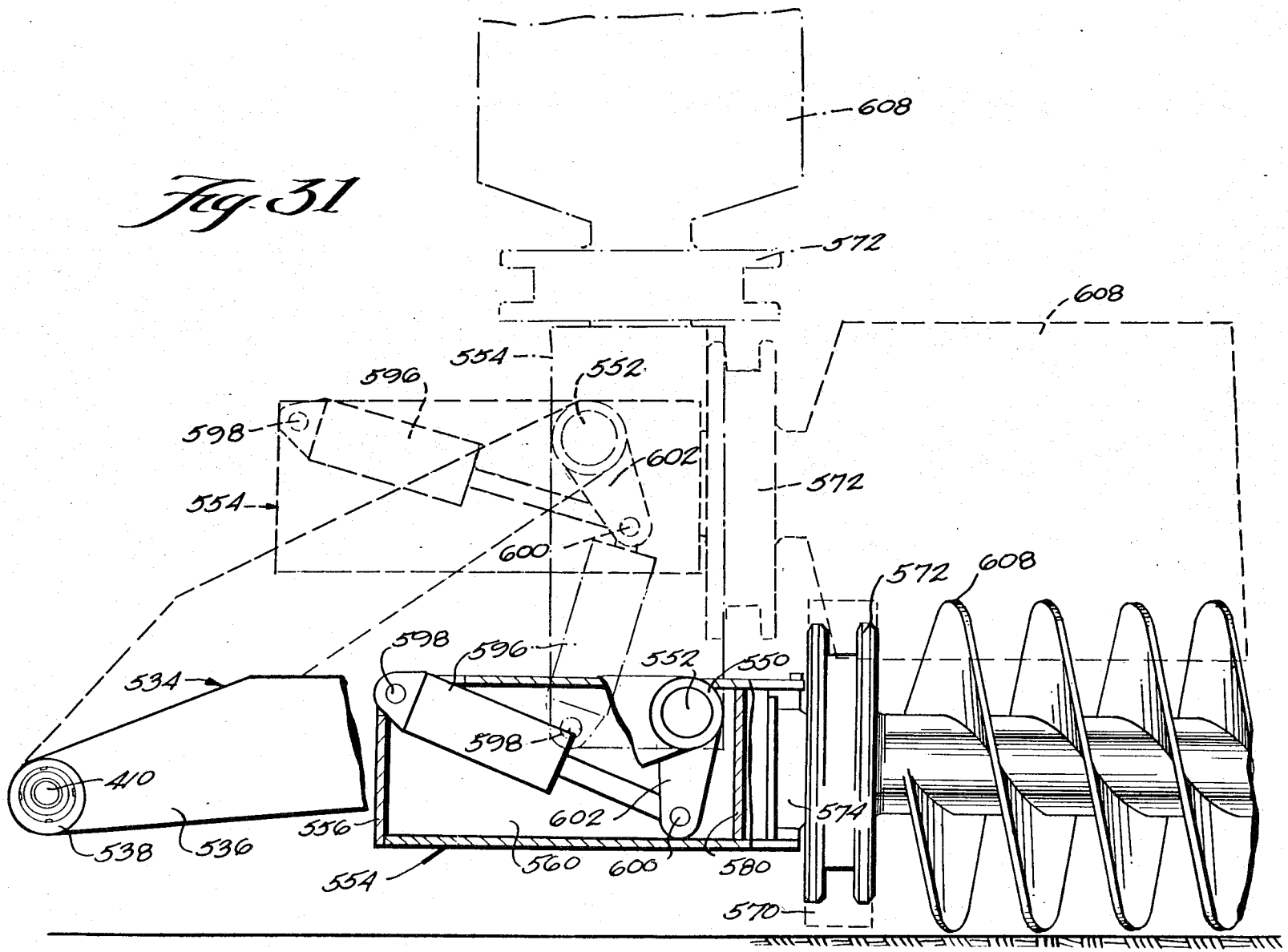
Figure 32:
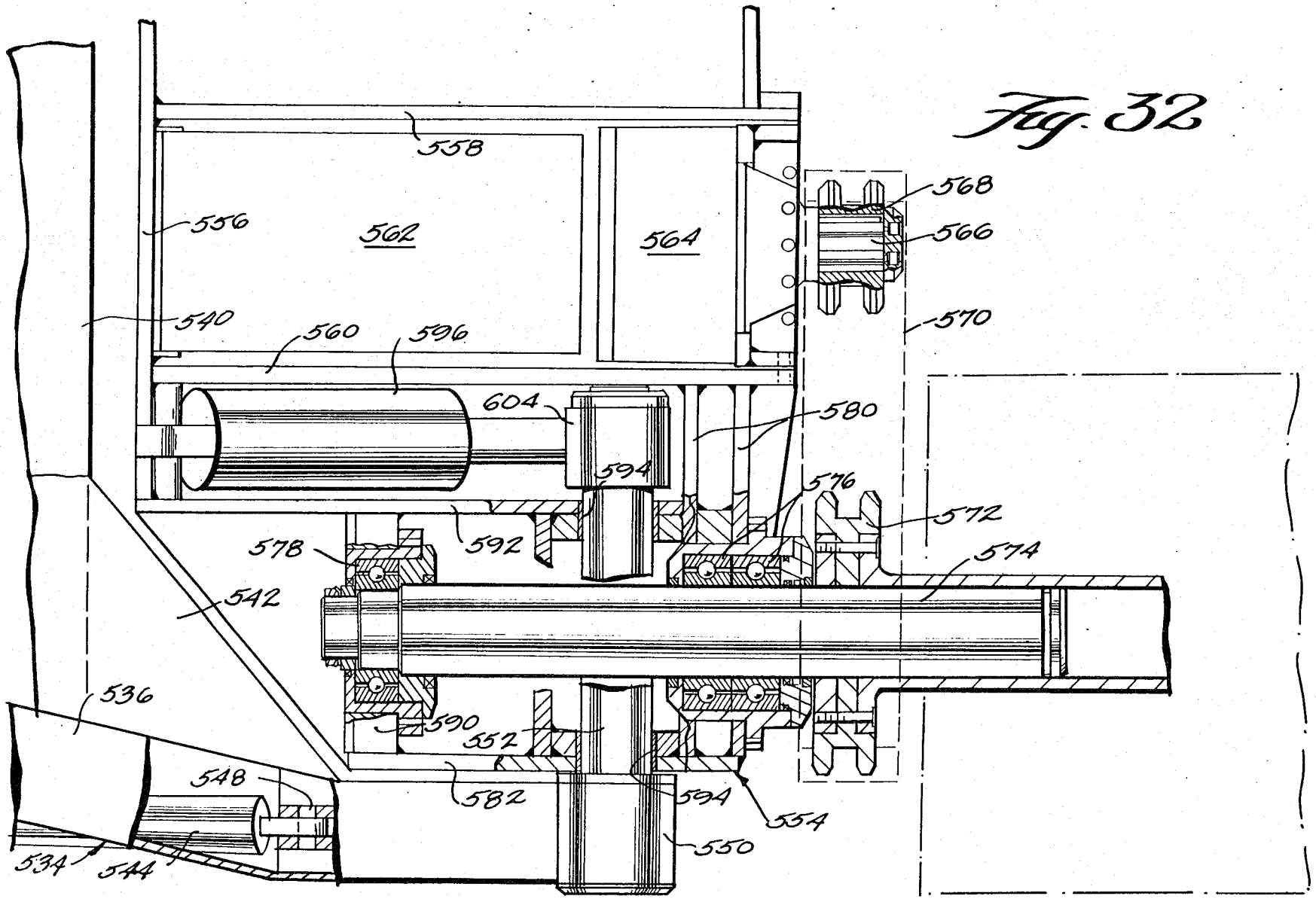
Figure 33:
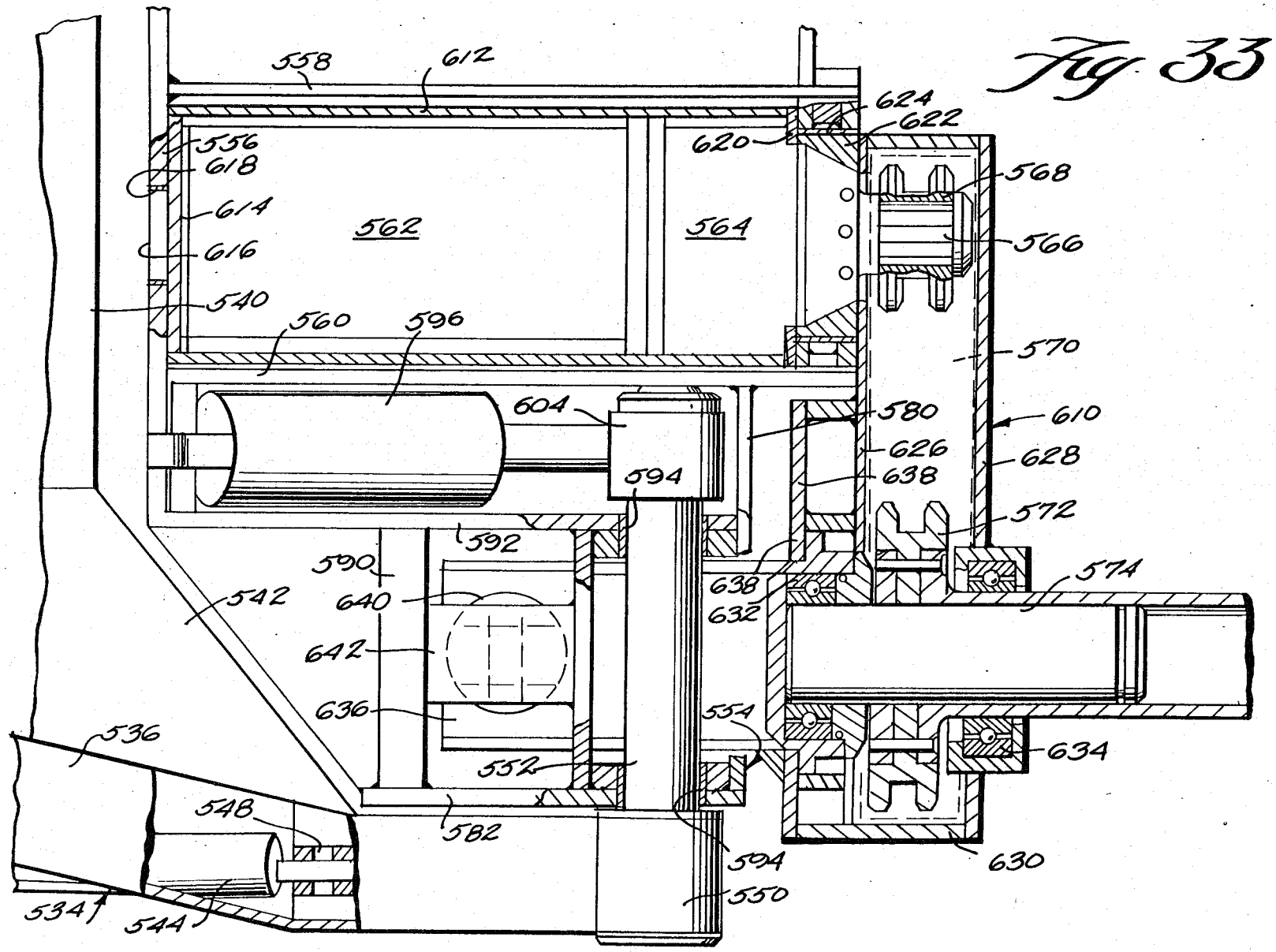

FIG. 12 is a fragmentary top plan view of the roof bolt installing mechanism on one side of the machine and the adjacent structure thereof, the mine roof bolting mechanism being shown in solid lines in its inner bolt installing position and in phantom lines in its outer bolt installing position;

FIG. 13 is an enlarged fragmentary sectional view taken along the line 13—13 of FIG. 12;

FIG. 14 is an enlarged fragmentary sectional view taken along the 14—14 of FIG. 12;

FIG. 15 is a top plan view of the roof bolt installing mechanism;

FIG. 16 is a sectional view taken along the line 16—16 of FIG. 15;

FIG. 17 is a view similar to FIG. 16 showing the rotary head of the roof bolt installing mechanism in an extended position as distinguished from the retracted position shown in FIG. 16;

FIG. 18 is a sectional view taken along the line 18—18 of FIG. 15;

FIG. 19 is a top plan view of the yoke structure of the movable frame structure assembly;

FIG. 20 is a front elevational view of the yoke structure shown in FIG. 15;

FIG. 21 is a left side elevational view of the yoke structure;

FIG. 22 is a sectional view taken along the line 22—22 of FIG. 20;

FIG. 23 is a fragmentary top plan view with parts broken away showing approximately one-half of the structure shown in FIG. 6, the limiting positions of the pivotal movement of the movable frame assembly being shown in phantom;

FIG. 24 is a cross-sectional view taken along the line 24—24 of FIG. 23;

FIG. 25 is a fragmentary side elevational view with parts broken away illustrating the movable frame structure and the adjacent portion of the rigid frame structure;

FIG. 26 is a top plan view of the gathering conveyor assembly with the remaining parts of the movable frame structure assembly removed;

FIG. 27 is an enlarged fragmentary sectional view taken along the line 27—27 of FIG. 26;

FIG. 28 is an enlarged fragmentary sectional view taken along the line 28—28 of FIG. 26;

FIG. 29 is a side elevational view of the gathering conveyor frame structure;

FIG. 30 is a fragmentary top plan view of the structure shown in FIG. 29;

FIG. 31 is a fragmentary side elevational view with parts broken away and in section illustrating the cutting mechanism with the auger cutters being shown in solid lines in their lower-most horizontally extending position, and in phantom lines in their upper-most vertically extending position;

FIG. 32 is a fragmentary top plan view with parts broken away and in section illustrating the right-hand auger cutter and associated structure;

FIG. 33 is a view similar to FIG. 31 illustrating modification of the mounting structure for the pair of auger cutters;

FIG. 34 is a view similar to FIG. 2 illustrating the continuous mining machine with a cutting mechanism of modified form and showing the position of the machine as it would proceed to mine a room extending 90° with respect to an entry in the mine, the cutting mechanism being shown at the end of the cutting cycle; and FIG. 35 is a schematic view illustrating the horizontal profile of two successive cuts in the mine seam by the cutting mechanism illustrated in FIG. 36.

Referring now more particularly to the drawings, there is shown in FIGS. 4 and 5 thereof a continuous mining machine, generally indicated at 10, which embodies the principles of the present invention. As best shown in FIGS. 4*a* and 4*b* the continuous mining machine 10 includes a central rigid frame structure, generally indicated at 12, which forms the forward end portion of the frame of an elongated conveyor assembly, generally indicated at 14. Conveyor assembly 14 functions to convey the coal cut from the mine face by the machine 10 in a direction rearwardly away from the mine face.

The conveyor assembly 14 is mounted for horizontal reciprocating movement on a carriage structure, generally indicated at 16, which, in turn is movably supported by a pair of power driven endless track units 18. Each of the endless track units is mounted on the carriage structure for independent vertical movement by a pivoted mounting arm assembly, generally indicated at 20.

Movably mounted on the forward portion of the rigid frame structure 12 is a movable frame structure, generally indicated at 22. The forward end of the movable frame structure 22 carries a power driven coal cutting and conveying mechanism, generally indicated at 24 which functions to cut the coal from the solid vein and to direct it rearwardly of the face. The movable frame structure 22 also carries a gathering conveyor assembly, generally indicated at 26, which serves to convey the coal cut by the coal cutting mechanism 24 rearwardly to the elongated conveyor assembly 14.

Figure 3:
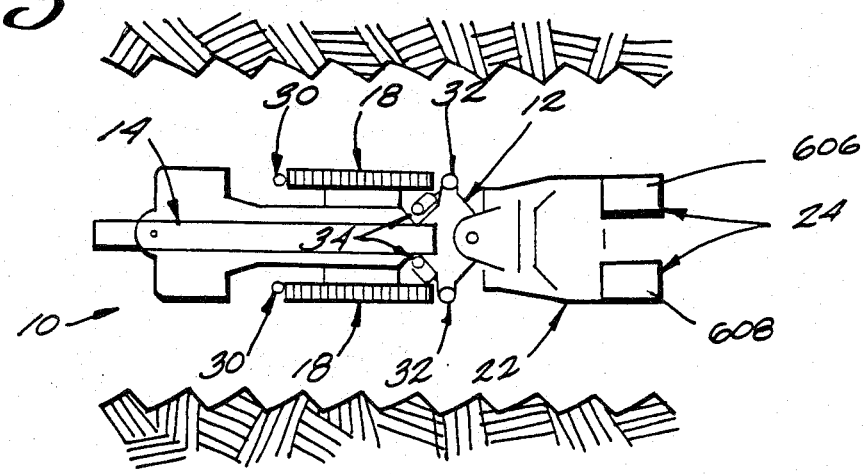
FIG. 3 is a view similar to FIG. 1 illustrating the tramming position of the continuous mining machine.

The conveyor assembly 14 is mounted for horizontal reciprocating movement on the carriage structure 16 between two limiting positions, one of which, as shown in FIG. 3, constitutes a tramming position and the other of which as, shown in FIGS. 1 and 2, constitutes an advanced operative position. Connected between the rigid frame structure 12 and carriage structure 16 on opposite sides of the elongated conveyor assembly 14 is a pair of hydraulic piston and cylinder units or rams 28 which serve to effect the horizontal reciprocating movements of the rigid frame structure 12 together with the movable frame structure 22, coal cutting and conveying machine 24, and gathering conveyor assembly 26 carried thereby, between the tramming positions and advanced operating positions thereof.

As shown in FIG. 3, when the rigid assembly is in its tramming position, a substantial portion of the elongated conveyor assembly 14, including the associated portion of the rigid frame assembly 12, extends rearwardly of the power driven endless track units 18, so as to provide a weight balance for the portion of the rigid frame 12 and associated portion of the conveyor assembly 14 which extends forwardly and the movable frame structure 22 connected therewith, as well as the coal cutting and conveying machine 24 and gathering conveyor assembly 26 carried by the movable frame structure 22. It will be understood that in this relatively balanced condition the machine can be trammed or moved along the mine floor by operating the power driven units 18.

Once the machine 10 has been moved into a position adjacent a mine seam to be mined, hydraulic rams 28 can be actuated to move the frame structure 12 and all of the structure supported thereon forwardly into its advanced operating position. This movement, which corresponds with a sumping movement of the coal cutting and conveying machine 24 into the mine seam, creates a forward weight imbalance of the rigid frame structure 12 and the structure carried thereby with respect to the carriage assembly 16 and endless track units 18.

In order to stabilize the endless track units and to prevent the same from assuming an exaggerated tipping posture, there is provided a pair of roof engaging jack assemblies 30 on the rearward end portion of each of the endless track units 18. In addition, in order to stabilize the rigid frame assembly 12 in its advanced operative position, there is provided a pair of floor to roof assemblies 32 on opposite sides of the forward end portion of the rigid frame structure 12. It will be noted that the floor to roof jack assemblies 32 are disposed in a position which is just forwardly of the forward ends of the endless track units 18 when the rigid frame assembly 12 is in its tramming position. When the latter is in its advanced operative position, the floor to roof jack assemblies 32 are spaced forwardly of the endless track units 18, leaving the central space disposed just forwardly of the endless track units occupied solely by the associated portion of the elongated conveyor assembly 14, which has a width less than the distance between the endless track units 18. This space and the relatively central portion of which is occupied by the elongated conveyor assembly 14, permits the installation of mine roof bolts at a distance approximately 12 feet from the face of the coal within which the coal cutting and conveying mechanism 24 has been sumped. The position of the installation of the roof bolts is approximately on four-foot centers, with respect to one another, with two bolts being mounted on each side of the elongated conveyor assembly 14. In order to facilitate the installation of the mine roof bolts, there is swingably mounted on each side of the rigid frame structure 12 a roof bolt installing mechanism, generally indicated at 34. As shown, the swinging axis of each mine roof bolt installing mechanism is coincident with the vertical axis of the associated floor to roof jack mechanism 32.

Referring now more particularly to FIGS. 6 through 8, it will be noted that the elongated conveyor assembly 14 is preferably of conventional scraper conveyor construction and, more specifically, a scraper conveyor embodying a single central endless chain 36 having a multiplicity of scraper flights 38 extending laterally therefrom in opposite directions. In accordance with conventional practice, the rigid frame structure 12 includes an upper operative run pan 40 and a lower return run pan 42. The upper and lower pans 40 and 42 are maintained in fixed vertically spaced relation by a pair of side frame members 44.

The central portion of the elongated conveyor assembly 14 is positioned between the endless track units and is mounted on the carriage structure 16 at a relatively high level. The portion of the elongated conveyor assembly 14 extending forwardly of the endless track units 18, is inclined downwardly and forwardly, and the associated frame structure 12 is shaped accordingly. It will also be understood that suitable guides are provided for causing the endless chain 36 and scraper flights 38 to remain closely adjacent the angled pan sections in accordance with conventional practice.

FIG. 7 illustrates the forward end of the elongated conveyor assembly 14, it being noted that the chain 36 is trained about a forward sprocket 45, mounted on a shaft 47 suitably journaled between the forward ends of the side rails 44.

In the preferred embodiment shown, the elongated conveyor assembly 14 is formed with a pair of movable rearward sections 46 and 48, the forward one of which includes a frame consisting of upper and lower pans 50 fixed in vertically spaced relation by side rails 52. The forward ends of the side rails 52 are pivoted to the rearward ends of the side rails 44 of the rigid frame structure 12, as indicated at 54, for vertical swinging movement about a horizontal transverse axis. The vertical swinging movements of the forward section 46 are effected by any suitable means, which as shown is preferably in the form of a pair of hydraulic piston and cylinder units 56 pivoted at their piston rod ends to the outer sides of the side rails 52 and at their cylinder ends to a pair of laterally spaced rearwardly extending frame sections 58 forming fixed rearward portions of the rigid frame structure 12.

The rearward movable conveyor section 48 includes a frame consisting of a pair of upper and lower pans 60 fixed in vertical spaced relation by side rails 62. The forward end of the pans 60 and side rails 62 are configured with respect to the cooperatively configured rearward end of the pans 50 and side rails 52 of the forward section 46 so as to enable the rearward section 48 to be moved with and by the forward section 46 when the latter is moved about its pivot 54 and with respect to the forward section 46 through horizontal swinging movements about a vertically extending pivotal axis, indicated at 64. The horizontal swinging movements of the rearward conveyor section 48 with respect to the forward conveyor section 46 about axis 64 is accomplished by any suitable means which as shown is preferably in the form of a pair of hydraulic piston and cylinder units 66 suitably mounted between the slide rails 52 and 62 along opposite outer sides thereof.

Endless chain 36 of the conveyor assembly 14 extends around a rearward sprocket wheel 68 fixed to the central portion of a shaft 70 the ends of which are journaled, as indicated at 72, on the side walls 62. The journals 72 for the shaft 70 are adjustable horizontally by chain tensioning or take up mechanisms 74 in accordance with conventional practices.

It will be understood that the power requirements of the machine 10 may be provided in any known manner typically an electrical motor and hydraulic pump assembly, such as the unit 74 shown in FIG. **4*b* is utilized. As shown, the unit 74 is fixed to the rigid frame structure 12 in a position rearwardly of the left endless track unit 18. The corresponding position behind the right endless track unit 18 provides a fixed operator's platform 76 disposed closely adjacent the mine floor. Preferably as shown, a canopy structure 78 is pivoted to the rigid frame structure 12, as indicated at 80, in a position above the platform 76. The vertical position of the canopy is adjustable by any suitable means, as, for example, by a hydraulic piston and cylinder unit 82 approximately mounted between the rearward portion of the platform 76 and the rearward portion of the canopy 78. Mounted on the forward portion of the operator's platform 76 is an hydraulic valve console 84** for operating many of the piston and cylinder units all of which is in accordance with established practice.

Referring now more particularly to FIGS. 9–11, a feature of the present invention is that the preferred manner of reciprocatingly mounting the rigid frame structure 12 on the carriage structure 16 and of pivotally mounting the carriage structure on the endless track unit is illustrated therein. As best shown in FIG. 11, fixed, as by bolts 86, to the outer surface of each side frame member 44 of the rigid frame structure 12 are three longitudinally spaced apertured brackets 88. Extending through the apertures in each set of three brackets 88 and fixed thereto is a longitudinally extending upper guide rod 90 and a parallel coextensive lower guide rod 92.

The carriage structure 16 includes an under carriage plate 94 which extends beneath the lower pan 42 of the rigid frame structure 12. As best shown in FIG. 11, the adjacent portion of the side frame members 44 extend below the lower pan 42 and have a bottom wear plate 96 welded across the lower edges thereof in a position to be slidably engaged by the carriage plage 94. The space defined vertically by the bottom plate 96 and lower pan 42 and horizontally by the side frame members 44 is preferably utilized as a sump for the hydraulic fluid used in the system including the motor-pump unit 74 and the various hydraulic piston and cylinder units connected therewith through valve console 84. As shown, the interior of the sump is defined by welded plates 98. Extending between the pair of forwardmost brackets 88 and the pan of rearwardmost brackets 88 are transversely extend-stop plates or bars 100 (see the righthand side of FIG. 11) which serve to limit the longitudinal reciprocation of the under carriage plate 94.

The carriage structure 16 also includes two pairs of forward and rearward slide members 102 and 104 welded to reinforcing cross-members (not shown) welded to the forward and rearward edges of the undercarriage plate 94. The forward and rearward pairs of slide members 102 and 104 are slidable along guide rods 90 and 92 forwardly of the rearward-most brackets 88 and the central brackets 88 respectively and provide guided support in addition to wear plate 96 for the reciprocating movement of the carriage structure 16.

Each lower guide rod 92 also serves as the means for connecting the associated pvioted mounting arm assembly 20 to the carriage structure 16 and rigid frame structure 12. As best shown in FIGS. 9 and 11, each mounting arm assembly 20 includes a pair of longitudinally spaced mounting arms 106, the central inner portions of which are rigidly interconnected by a welded connector plate 108. The inner ends of the arms 106 are apertured, as at 110, to slidably and rotatably receive therethrough the lower rod 92. As best shown in FIG. 9, each rearward mounting arm 106 is forwardly adjacent the associated slide member 104 and each forward mounting arm 106 is rearwardly adjacent the associated slide member 102. In this way, as the carriage structure 16 is moved longitudinally in either direction along the guide rods 90 and 92, the mounting arm assemblies 20 will be moved longitudinally in either direction as well while being capable of independent pivotal movement about the axis of the associated lower guide rod 92.

The position of vertical pivotal movement of each mounting arm assembly 20 is determined by extending and retracting a pair of piston and cylinder units 112. As best shown in FIG. 11, each slide member 102 and 104 has a laterally extending arm 114 fixed thereto to which the cylinder of the associated unit 112 is pivoted, as indicated at 116. The piston rod end of each unit is pivoted to the outer central portion of the adjacent mounting arm, as indicated at 118. The piston and cylinder units 28 which serve to effect the relative longitudinal reciprocatmovement of the rigid frame structure 12 with respect to the carriage structure 16 and mounting arm assemblies 20, are each mounted with their cylinders disposed rearwardly and pivoted, as at 120 to brackets 122 suitably fixed to the outer surface of the adjacent side frames members 44. The forward piston ends of the units are pivoted, as at 124, to brackets 126 suitably fixed to the forward slide members 102.

As best shown in FIG. 5*b*, each endless track unit 18 is of conventional construction including a frame 128 which rotatably supports a pair of longitudinally spaced main rollers 130, at least one of which is power driven, around which an endless track 134 is trained. The upper and lower runs of the endless track 134 are supported between the rollers 130 by the upper and lower wear plates 132. As shown somewhat schematically in FIG. 11, each frame 128 is formed with a pair of laterally inwardly cpening recesses 136 within which to receive the outer ends of the mounting arms 106 of the associated mounting arm assembly 20. The outer end of each mounting arm 106 is apertured as at 138 to pivotably receive therein a pivot pin 140 fixedly carried by the frame 128 in a position such that its axis is disposed within a vertical plan substantially bisecting the associated endless track unit 18. As best shown in FIG. 9, each roof engaging jack assembly 30 is mounted in a position rearwardly of the associated endless track 134 by a cantilever frame structure 142 suitably fixed to the adjacent rearward interior position of the associated track frame 128.

Referring now more particularly to FIGS. 12–14, a preferred embodiment of a floor to roof jack assembly 32 is shown in detail therein. Since both of the assemblies 32 are of similar construction, a description of one will suffice to give an understanding of both. As best shown in FIGS. 6–8, at the forward end of the endless conveyor 14, the rigid structure 12 is formed with a bottom plate 144 which is welded beneath the bottom pan 42 and extends laterally outwardly in both directions beyond the lower edges of the side frame members 44. A similarly shaped top plate 146 is suitably fixed as by welding, across the upper edges of the side frame members 44.

The lateral edges of the plates 144 and 146 at each side are concavely arculately formed to fixedly engage as by welding one side of the exterior periphery of an outer cylindrical member 148 forming a part of the associated floor to roof jack assembly 32. As best shown in FIG. 13, the upper end of the outer cylindrical member 148 is closed by a manifold disk 150 and the lower end is open. Mounted within the outer cylindrical member 148 and extending downwardly through the lower open end thereof is an intermediate cylindrical member 152. The upper end of the intermediate cylinder member is formed with exterior seals 154 which slidably sealingly engage the interior periphery of the outer member 148. Interior seals 156 are formed on an inwardly enlarged portion adjacent exterior seals 154.

Fixed to the manifold disk 150 and extending downwardly therefrom are pair of fixed abutting tubes 158 and 160. The outermost tube 158 has an outward enlargement on its lower exterior periphery which is provided with exterior seals 162 slidably sealingly engaging the interior periphery of the intermediate member 152. The exterior periphery of the tube 158 and the interior periphery of the intermediate member 152 define an annular pressure space 164 between seals 156 and 162 which when communicated ith hydraulic fluid under pressure applies a force on the intermediate member 152 acting to move it upwardly into the collapsed position shown in FIG. 13.

As shown, the hydraulic fluid under pressure comes from an exterior line 166 leading into a passage 168 formed in the manifold disk 150. Passage 168 leads to the upper end of an axial groove 170 formed in the exterior periphery of the tube 160, the lower end of which leads to an opening 172 extending through the outer tube 158 just above seals 162. Hydraulic fluid under pressure from a second exterior line 174 is communicated with the upper surface of the intermediate member 152 to move it downwardly through a passage 176 formed in the manifold disk 150.

Slidably sealingly mounted within the inner tube 160 is a piston 178 dividing the interior of the tube into upper and lower variable volume chambers 180 and 182. A piston rod 184 is fixed to the piston 178 and extends upwardly through a central opening in the manifold 150,which opening has interior seals 186 therein. Fixed to the upper end of piston rod 184 is a roof engaging member 188.

Hydraulic fluid under pressure is communicated with upper chamber 180 to move the piston 178, piston rod 184 and roof engaging member downwardly into the collapsed position shown in FIG. 13 by a passage 190 within the manifold disk 150 leading from the passage 168 to the upper end of the chamber 180. Hydraulic fluid under pressure for the lower chamber 182 comes from the passage 176. As shown, a parallel passage 192 in the manifold disk 150 leads from the passage 176 to the upper end of a second axial groove 194 formed in the exterior periphery of the inner tube 160. The lower end of the groove 194 leads to an opening 196 extending through the lower end of the inner tube 160 just above a lower end closure 198 fixedly mounted therein to define the bottom surface of the lower chamber 182. An apertured floor-engaging member 200 is fixed within the lower end of the intermediate member 152 below the end closure 198.

The outer cylindrical member 148 of each floor-to-roof jack assembly 32 provides a pivot for a mounting arm 202 which carries the associated roof bolt installing mechanism 34. As best shown in FIGS. 13 and 14, the forward end of each arm 202 is formed in an arcuate configuration and is fixedly secured, as by welding, to the periphery of a flanged half sleeve member 204. The flanged half sleeve member 204 extends halfway around the exterior periphery of the associated cylindrical member 148, between the bottom and top plates 144 and 146 connected therewith. A second flanged half sleeve 206 surrounds the remainder of the outer cylindrical member 148 and is fixedly engaged with the half sleeve 204, as by bolts 208.

As previously indicated, each moving roof bolt installing mechanism 34 is movably carried by the associated mounting arm 202 for swinging movement into two operating positions. FIG. 12 illustrates the two operating positions of the lefthand roof bolt installing mechanism 34 and the preferred means for effecting the movement between the two positions. As shown, the preferred means comprises a piston and cylinder unit 210 having its cylinder end suitably pivoted, as indicated at 212, between the adjacent portions of the bottom and top plates 144 and 146. The piston rod end of the unit 210 is pivoted to an intermediate portion of the mounting arm 202 as indicated at 214.

The rearward end of each mounting arm 202 is formed with a pair of fixed vertically extending parallel sleeves 212 within which the associated roof bolt installing mechanism 34 is mounted for vertically adjusted movement. As best shown in FIGS. 14, 16 and 17, each roof bolt installing mechanism 34 includes a main bottom plate 218 having a pair of mounting rods 220 extending vertically upwardly therefrom and suitable fixed thereto, as by welding. The mounting rods 220 are slidably received within the mounting arm sleeves 216. In this way, the roof bolt installing mechanism 34 is mounted,for rectilinerar vertical movement. As best shown in FIG. 14, the rectilinear movements of each roof bolt installing mechanism are accomplished by any suitable means, such as a hydraulic piston and cylinder unit 222 having its lower cylinder end pivoted to the base plate 218, as indicated at 224. The upper piston rod end of unit 222 is pivoted, as indicated at 226, to a bracket 228 welded to the upper rearward surface of the rearward end of the mounting arm 202.

It will be understood that by extending the piston and cylinder unit 222, base plate 218 of the roof bolt installing mechanism 34 will be moved downwardly with respect to the mounting arm 202 into an operative position in supported engagement with the floor of the mine. When it is desired to move the roof bolt installing mechanism 34 to another operating position or to otherwise move the roof bolt installing mechanism as when the machine 10 is being trammed or the rigid frame structure 12 is being move forwardly, the piston and cylinder unit 222 is retracted to raise the associated roof bolt installing mechanism 34 out of floor supporting relation into a raised position carried by the associated arm 202.

Referring now more particularly to FIG. 15 through 18, there is shown therein a preferred embodiment of the roof bolt installing mechanism 34. Here again, since each of the two roof bolt installing mechanisms are of similar construction, a description of one will suffice to give an understanding of the structure and operation of both. In order to anchor and stabilize the roof bolt installing mechanism 34 in its operative position, there is provided a pair of parallel jacks in the form of two hydraulic piston and cylinder units 230. Each of the units is formed of the usual components including a cylinder 232 and a piston rod 234. Each unit 230 is oriented with its cylinder 232 lower-most and the upper end of the piston rod 234 is provided with roof engaging element 236. Each cylinder 232 is disposed in fixed relation, as by bolts 238, extending through the base plate 218 upwardly therein and by an upper bracket 240 which is fixed, as by bolts 242, to the upper end of the mounting rods 220. Bracket 240 is also fixed, as by bolts 244, to a ledge 246 suitably welded to the upper end of each cylinder 232.

The roof bolt installing mechanism 34 also includes a power driven rotary mechanism indicated at 248. The power driven rotary mechanism 248 is of conventional construction and is adapted to have mounted in conjunction therewith successively a roof drill and a roof bolt. As shown in FIG. 17 only, a drill locator 250 may be utilized in conjunction with the power driven rotary mechanism 248 all in accordance with the conventional practice.

The rotary mechanism 248 is connected with a short stroke elevating mechanism,generally indicated at 252, which, in turn, is carried by a long stroke elevating mechanism, generally indicated at 254. The long stroke elevating mechanism 254 is carried by the base plate 218 and includes a hydraulic piston and cylinder unit 256 formed of the usual components including a cylinder 258 and piston rod 260. As best shown in FIG. 17, the unit 256 is oriented with its piston rod 260 lower-most and the lower end of the piston rod 260 is fixed to the base plate 218, as by a disk mounting member 262 suitably welded therebetween. The long stroke elevating mechanism 254 is guided for vertical movement by a lower guide bracket assembly 264 which extends from the lower end of the cylinder 258 and slidably embraces the exterior periphery of at least one of the two stabilizing cylinders 232. The upper end of the long stroke elevating mechanism 254 includes a guide plate 266 fixed thereto and extending outwardly therefrom is slidable embracing relation with respect to at least one of the piston rods 234 of the stabilizing units 230. Fixed to the upper end of the cylinder 258, as by bolts 268, is a mounted plate 270 the lateral edges of which are shaped to engage the upper ends of a pair of guide tracks 272. As best shown in FIG. 15, the upper ends of the guide tracks 272 are suitably welded to the mounting plate 270 and are of channel or U-shaped configuration.

The short stroke elevating mechanism 252 is provided with a pair of laterally spaced vertically extending parallel guide plates 274 positioned outwardly of the guide tracks 272. Each guide plate 274 has fixed thereto a pair of vertically spaced roller shafts 276 which extend inwardly into the open channel defined by the adjacent guide track 272. Mounted on the inner end of each shaft 276 is a guide roller 278.

Guide plates 274 are fixed to the frame of the power driven rotary mechanism 248 by any suitable means, such as bolts 280, the arrangement being such that the rotary mechanism 248 is mounted within the guide tracks 272 by the rollers 278 for vertical rectilinear movement. In order to effect this movement, the cylinder 258 is utilized as a piston rod as best shown in FIG. 18, an annular piston 282 is formed on the central exterior periphery of the cylinder 258. Mounted over the cylinder 258 in sliding sealing relation to the annular piston is a short cylinder 284 having opposite end closures 286 allowing the cylinder 258 to sealingly pass therethrough. The motion of the short cylinder 284 is transmitted to the rotary mechanism 248 by a pair of endless chain assemblies,generally indicated at 288, each of which includes a chain guide bar 290 welded to the adjacent periphery of the short cylinder 284. Fixed to the guide bar 290, as by bolts 292, is a vertically elongated central chain retaining member 294. The upper and lower ends of the chain retaining member 294 receive shafts 296 on which upper and lower chain rollers 298 are mounted. Trained about the upper and lower rollers 298 is a length of chain 300 the ends of which are connected with a pair of lugs 302 so as to provide an endless chain trained about the rollers 298 with the vertical runs therebetween interiorly engaging the vertically extending surfaces of the guide bar 290.

As best shown in FIG. 15, each pair of lugs 302 is formed integrally with a mounting block 304 fixed, as by a bolt 306, within a slotted mounting box 308 suitably welded to the frame of the rotary mechanism 248.

Each chain 300 includes an outwardly extending lug type link 310 in its central portion. Each lug link 300 is fixedly connected, as by bolts 312, to a stop block 314 which is suitably welded to an adjacent outer surface of the associated track guide 272. It can be seen that when hydraulic fluid under pressure is introduced into the cylinder 284 above the annular piston 282, the cylinder 284 and the endless chain assemblies 288 carried thereby will be moved upwardly with respect to the cylinder 258. Since stop blocks 314 hold the lug links 310 against movement with respect to the guide tracks 272 and hence the cylinder 258, the resultant upward movement of the cylinder 284 causes the lugs 302 which are connected with the chain 300 to move upwardly. The upward movement of the lugs 302 carries mounting blocks 304 therewith which, in turn, move the power driven rotary mechanism 248 upwardly therewith. In this way the short stroke elevating mechanism 252 is operable to move the rotary mechanism 248 through a short stroke which is equal to slightly less than ½ the length of the cylinder 258. The long stroke mechanism 254 is operable to effect the rotary mechanism 248 through a long stroke slightly greater than the length of cylinder 258 by simply introducing hydraulic fluid under pressure into the upper end of the cylinder 258 so as to extend the piston and cylinder unit 256 which has the effect of moving the cylinder 258 upwardly which, in turn, carries with it the short stroke elevating mechanism 252 and the rotary mechanism 248.

It will be understood that in operation the stabilizing units 230 are moved into roof engagement to stabilize the roof bolt installing mechanism 34 before the actual installation process is begun. The usual procedure would be to connect a drill bit with the rotary mechanism 248 with the latter in its lower-most position and then to raise the same upwardly utilizing the elevating mechanism 252 and 254 as aforesaid. In this endeavor the drill locator assembly 250 is utilized. After the hole has been drilled, the rotary mechanism 248 is lowered by reversing the hydraulic fluid communications within the cylinders 258 and 284. The locator assembly 250 is then removed and the rotary mechanism 248 is fitted with a roof bolt to be installed. Next, the rotary mechanism 248 is raised by the operation of the elevating mechanisms 252 and 254 as aforesaid to move the bolt into the drilled hole and to tighten the same therein. The installation is completed by lowering the rotary mechanism 248 and the stabilizing units 230.

As best shown in FIG. 7 the lower and upper plates 144 and 146 of the rigid frame assembly 12 extend forwardly of the forward end of the conveyor 14 and have suitably journaled in the forwardly extending portions thereof a vertical pivot pin or shaft 316. The lower end of the shaft 316 is journaled in bottom plate 144 by a bearing assembly 318 and the upper end portion of the shaft 316 is suitable journaled in the upper plate 146 as by a spherical bearing assembly 320. Shaft 316 serves to connect the rigid frame structure 12 with the movable frame structure 22 so as to provide for a horizontal swinging movement of the movable frame structure 22 about the vertical axis of the shaft 316. To this end, the movable frame structure 22 includes a yoke structure, generally indicated at 322, which is fixed to the shaft 316 so as to be swingable therewith in a horizontal plane about its vertical axis.

Referring now more particularly to FIGS. 7 and 19-23, the yoke structure 322 includes a vertical sleeve 324 surrounding the central portions of the shaft 316 affixed thereto as by a set screw 326. The yoke structure 322 also includes a horizontally extending sleeve 328 disposed centrally forwardly of the vertical sleeve 324. Sleeve 328 is rigidly fixed with respect to sleeve 324 by a top plate 330 forming a part of the yoke structure which extends forwardly from the upper end of the vertical sleeve 324 in overlying relation to the horizontal sleeve 328 and is suitably fixed thereto as by welding or the like. A short reinforcing member 332 is welded between the rearward central portion of the horizontal sleeve 328 and the adjacent portion of the vertical sleeve 324. The top plate 330 extends outwardly at each side beyond the associated end of the horizontal sleeve 328. Fixed to the outer extremity of each side of the top plate 330 is a ring or sleeve section 334. Each ring 334 is mounted so as to be disposed in spaced relation with respect to the adjacent end of the horizontal sleeve 328 but with its axis aligned with the axis of the sleeve.

The yoke structure 322 also includes a lower plate 336, which is parallel with the upper plate 330 and is generally coextensive with the forward portion thereof. A central upstanding reinforcing plate 338 is suitable welded to the upper surface of the bottom plate 336 and to the forward lower central portion of the horizontal sleeve 328. A pair of upwardly and forwardly extending horizontally spaced bracket plates 340 are fixed to the forward portions of the top plate 330 and the bottom plate 336 which are suitably reduced. The bracket plates 340 are reinforced and apertured, as indicated at 342, at their upper forward portions for a purpose hereinafter to be more fully described. A forward plate 344 extends between the bracket plates 340 and is suitably welded thereto and to the top and bottom plates to reinforce the bracket plates 340.

As shown in FIGS. 20 and 22, forward plate 344 is apertured, as indicated at 346, and adjacent portions of the upper and lower plates 330 and 336 are apertured, as indicated at 348 and 350 respectively, for a purpose hereinafter to be more fully described. To further strengthen the interconnection between the vertical sleeve and the horizontal sleeve, suitable horizontal reinforcing plates 352 are fixed between the lower end of the sleeve 324 and the vertical reinforcing plate 338 and the adjacent portion of the bottom plate 340. Angular gussets 354 are suitably welded to the forward central portion of the horizontal sleeve 328 and to the adjacent outer surfaces of the bracket plates 340.

Referring now more particularly to FIGS. 8 and 23–25, there is shown therein a preferred means for effecting the pivotal movement of the yoke structure 322 about the axis of the vertical shaft 316. As shown, the movement effecting means includes a piston and cylinder unit 356 pivoted to each laterally outward end of the yoke structure 322. As best shown in FIG. 24, a reinforcing block 358 is welded beneath the upper plate 330 at each laterally outward end thereof. Each block 358 has a vertical bore 360 formed therein which communicates at its upper end with a larger aperture 362 in the upper plate 330. The bore 360 is slotted at its lower end, as indicated at 364. Slot 364 is sized to receive an upper apertured boss 366 welded to the upper central portion of the cylinder of the piston and cylinder unit 356. A corresponding lower apertured boss 368 is welded to the lower central portion of the cylinder. An upper headed pivot pin 370 extends downwardly through bore 360 into the upper aperture boss 366 and a lower headed pin 372 extends upwardly into the lower boss 368 through a suitable counterbored opening 374 in the yoke bottom plate 336 and a reinforcing link 376 welded therebelow.

Referring now more particularly to FIGS. 6–8 and 25–32, there is shown therein the details of construction of the gathering conveyor assembly 26 and the manner in which the same moves with and with respect to 322 and cooperates with the elongated conveyor assembly 14 to transfer cut coal from the discharge end thereof to the receiving end of the conveyor assembly 14. As best shown in FIGS. 29–31, the gather conveyor assembly 26 includes a frame assembly comprising a U-shaped pan section generally indicated at 378, which is movable vertically with respect to the yoke structure 322 and a discharge pan section, generally indicated at 380, which is movable horizontally in supported relation on the forward end portion of the upper frame member 146. As best shown in FIG. 26, the U-shaped pan section 378 is a weldment made up of a lower pan element 382 defining the bight portion of the U-shaped pan section and two upwardly and rearwardly inclined pan elements 384 defining the leg portions of the U-shaped pan section 378 extending upwardly in spaced relation from the rear edge of the pan element 382 in generally upwardly converging relation. The rear edges of each inclined pan element 384 has a horizontal pan element 386 extending rearwardly therefrom which defines an associated horizontal free end portion of the U-shaped pan section 378.

Extending upwardly from the central portion of the bight pan element 382 in generally parallel relation to the arcuate outer edge thereof is an inner vertical rail or wall 388 which is suitably welded to the pan element 382. Each end of the rail 388 is continued rearwardly by an inner rail 390 welded along the inner edges of each of the associated leg pan elements 384 and 386. The leg pan elements 394 also are provided with outer side walls or rails 392 which are suitably welded along the outer edges thereof. In order to brace the legs of the U-shaped pan section 378, a pair of parallel bracing plates 394 are welded in transverse positions between the inner side rails 390. The lower edges of the bracing plates 394 are welded to a thinner bottom plate 396 which is of U-shaped configuration in plan and has its forward edge welded to the rearward edge of the bight pan element 382. A plate 398 is welded between the upper edges of plates 394 to give it a box-like structural configuration, the central portion of which is further strengthened by two pairs of forwardly diverging reinforcing plates 400, the forward edges of which are suitably welded to the side rails 388. To further strengthen the overall structure, a pair of top corner plates 402 are welded along the upper contiguous edges of each forward reinforcing plate 394, outermost reinforcing plate 400 and side rails 388 and 390.

Extending upwardly from each rearwardly extending leg portion of the U-shaped bottom plate 396 is a pair of rearwardly converging plates 404, the rearward portions of which are formed into an arm-like configuration with the extremities formed arcuately to receive a sleeve 406 which is welded thereto. In addition, at a position adjacent the rear edge of the leg portion of each bottom plate 396 there is fixedly welded a second transverse sleeve 408 which opens laterally. It will be understood that the plates 404 are suitably braced with other plate elements which are included in the weldment.

The rearward sleeves 406 are open at both ends and are sized axially to be positioned between the outer ends of horizontal sleeve 328 of the yoke structure 322 and the end sleeve sections 334 thereof. As best shown in FIGS. 8 and 24, a pivot pin or shaft 410 is mounted through the axially aligned sleeves 328, 406 and 334 so as to serve to pivotally connect the entire U-shaped pan section 378 to the yoke structure 322 for swinging movement therewith about the axis of the vertical yoke shaft 316 and for vertical swinging movement with respect to the yoke structure about the axis of the shaft pin or shaft 410. Any suitable means may be provided for effecting the relative pivotal movement of the U-shaped pan section 378, and as best shown in FIGS. 25 and 26, a preferred movement effecting means comprises a hydraulic piston and cylinder unit 412, the cylinder end of which is pivoted, as at 414, within the openings 342 of the bracket plates 340 of the yoke structure 322. The piston end of the unit 412 is pivoted, as at 416, between a pair of apertured ears 418 welded to the rearward reinforcing plate 396.

The discharge pan section 380 includes a pair of relatively short pan elements 420 which are disposed in a horizontal position spaced slightly above the top frame member 146 of the rigid frame structure 12. Mounted between the pan elements 420 and the upper surface of the top frame member 146 are a pair of movable segmental pan elements 422. The radially inward ends of pan elements 422 are fixed to a hub and bearing assembly 426, rotatably mounted on the vertical shaft 316 above the frame member 146. The segmental pan elements 422 are limited to a 45° rotational movement as by an abutment block 426 welded to the upper forward surface of the top frame member 146. The movable pan elements 422 which form a part of the discharge pan section 380 slide upon the upper surface of the frame member 146. The upper surface of pan elements 422, in turn, serve to slidably support the pan elements 420 for relative horizontal arcuate slide movement thereover.

Each pan element 420 has welded to the outer edge thereof a pivotal plate 428 which extends forwardly between the outer surface of the rear end of the associated outer side rail 392 and a pivotal plate 430 suitably fixed thereto in spaced relation. As best shown in FIGS. 8 and 25, a pivot pin 432 extends through appropriate openings in plates 428 and 430 and the adjacent side rail, the arrangement being such as to accommodate a very slight amount of relative vertical movement therebetween. Similarly, a pivot plate 434 is fixed to the outer rear surface of each inner rail 390 and extends rearwardly between a pair of pivot plates 436 suitably fixed with respect to the associated pan element 420. As before, a pivot pin 438 (FIGS. 7 and 8) extends between the pivot plates 438 and 434 and, as before, the arrangement is such as to accommodate a slight amount of vertical movement therebetween.

The rearward end of each pivot plate 428 has connected therewith a limited hinge assembly 440 to which is connected for limited pivotal movement about the vertical axis of the hinge assembly an arcuate side rail 442. The rearward end of each arcuate side rail is connected to one end of a flexible arcuate side rail 444 which preferably is made of suitable flexible plastic material 146. The pins 446 extend upwardly from the frame member 146 at positions rearwardly of a segmental shaped discharge opening 448 therein. The pins 446 serve to cause the flexible rail 444 to assume a rearwardly bowed position defining a discharge area which is greater than the segmental opening 448. The limited pivotal movement of the side rails 442 provided by the hinge connections 440 and the flexibility of the arcuate side wall 444 accommodates the horizontal swinging movement of the entire gathering conveyor assembly 26 with the yoke structure 322 about the vertical axis of the vertical shaft 316. Preferably, the extent of this arcuate movement is approximately 90°. However, as previously indicated, the segmental pan elements 422 are mounted for a limited pivotal movement to an angular extent of 45°. FIG. 26 illustrates the segmental pan elements 422 in a limiting position into which the same are moved when the gathering conveyor assembly 26 is pivoted about axis of shaft 316 in a counter-clockwise direction, as viewed in FIG. 26, 45° from the position shown. When in this limiting position, an abutment 450, suitably welded to the bottom surface of the associated end pan element 386, is disposed in engagement with the forward edge of the associated pan element 422. A comparable abutment 452 is welded to the underside of the other end pan element 386. The position of the abutments 450 and 452 is such that a pivotal movement from the aforesaid limited position in a counter-clockwise direction through 45° into the position shown in FIG. 26 will bring the abutment 452 into engagement with the forward edge of the other pan element 422. Consequently, as the gathering conveyor assembly 26 is moved in a clockwise direction through a further 45° angular extent the position of the two segmental pan elements 422 will be reversed from that shown in FIG. 26 which constitutes the other limiting position thereof. It will be noted that the segmental pan elements 422 thus serve to bridge the gap between the pan elements 420 and the forward edge of the top frame member 146 which would otherwise occur at or near the extreme limiting positions of the gathering conveyor assembly 26 in each direction from the central position shown in FIG. 26.

In addition to the pan sections 378 and 380, the gathering conveyor assembly 26 includes a series of conveyor flights, generally indicated at 454, interconnected into an endless assembly by chain links 456.

As best shown in FIG. 27, each conveyor flight 454 includes a main guide block 458 having a guide slot 460 extending upwardly from the lower surface thereof and a pair of vertically spaced flanges 462 extending horizontally inwardly therefrom. Extending vertica11y between the flanges 462 is a pair of horizontally spaced pivot pins 464, each of which pivotally receives an adjacent chain link 456.

Fixed to the upper surface of each block 458 and extending horizontally inwardly therefrom in spaced relation to the upper flange 462 is a ledge scraping element 466. The lower outer surface of each block 458 is notched to receive the inner end of a pan scraping element 466 which extends horizontally outwardly therefrom. The scraping element 466 is reinforced and increased in vertical size by a triangular gusset plate 468 suitably welded along its lower edge to the central portion of the scraping element 466. An inclined top plate 470 is welded along the upper edge of each gusset plate 468 and extends inwardly into abutting engagement with the ledge scraping element 466.

Each conveyor flight 454 is guided for movement along the legs of the U-shaped pan section 378 by guide rails 472. Each guide rail 472 is welded to the central upper surface of the associated pan elements 386 and 384 and extends onto the adjacent portion of the bight pan element 382. Each guide rail 472 is shaped to guidingly engage within the guide slot 460 formed in the guide block 458 of each conveyor flight 454.

In order to improve the wear characteristics of the pan elements of the U-shaped pan section 378, there is provided a wear strip 474 which is welded to the upper surface of the pan elements 382, 384 and 386 along their outer peripheral portions through the entire U-shaped extent thereof. As best shown in FIG. 27, the outer portion of the pan scraping elements 466 ride along the upper surface of the wear strip 474 throughout their travel along the U-shaped pan section 378.

As best shown in FIG. 27, the endless assembly defined by the flights 454 and chain links 456 is guided interiorly for movement along each of the legs of the U-shaped pan section 378 by a vertical wall 476 having a wear strip 478 welded to the central portion thereof. The lower edge of each vertical wall 476 is welded to the associated pan elements 384 and 386 while the upper edge is welded to a ledge plate 480 welded along its inner edge to the associated inner wall 390. Each ledge plate extends outwardly over the associated vertical wall 476 so as to provide a relatively protected space within which the chain links move.

Mounted on the bight pan element 382 adjacent the connection of each leg pan element thereto is an idler sprocket wheel 482 around the outer periphery of which the endless assembly defined by the chain links 456 and conveyor flights are trained. As best shown in FIG. 26, each idler sprocket wheel 482 is rotatably mounted in a suitable bracket 484 fixed to the pan element 382. The adjacent inner rail 388 is suitably apertured to accommodate the sprocket wheel 482.

Spaced forwardly of each idler sprocket wheel 482 is a take-up sprocket wheel 486. As best shown in FIG. 28, each take-up sprocket wheel 486 is journaled, as by bearings 488 within a rigid housing structure 490. Housing structure 490 includes a rearwardly extending socket 490 within which is received the piston rod end of a hydraulic piston and cylinder unit 494. As best shown in FIG. 26, the cylinder of each unit 494 is fixedly received between the associated reinforcing plates 400, and the housing socket 492 is guided within an opening 496 formed in the adjacent portion of the inner rail 388. Piston and cylinder units 494 are preferably single acting and connected in the hydraulic system with a constant pressure accumulator circuit (not shown) which maintains the pressure constant,in accordance with known practice,during vertical movements of the U-shaped pan section 378 while allowing the units 494 to extend and retract to accommodate the changes in the interior dimensions of the endless assembly due to such vertical movements.

In order to provide positive guidance for the endless assembly including the chain links 456 and flights 454 between the take-up sprocket wheels 486 in any position of extension or retraction they may assume, an outer telescoping guide tube 498 of rectangular cross-sectional configuration is pivoted at one end, as indicated at 500, to one of the housing structures 490, and extends toward the other. A cooperating inner tube 502 is telescopically mounted within the outer tube and has its outwardly extending end pivoted, as at 504, to the adjacent housing structure 490. It can be seen as the take-up sprocket wheels 486 are moved outwardly and inwardly with their housing structures 490 due to the extension and retraction of the units 494, the telescoping guide tubes 498 and 502 will be carried outwardly and inwardly in proper chain guiding relation as well with the connections 500 and 504 effecting an outward and inward telescopic movement relatively between the tubes.

The sprocket wheels 482 and 486 and movable telescopic guide assembly 498-502 are all protected from direct exposure to cut coal by a curved ledge plate 506 welded along its inner edge to the inner rail 388 so as to form a continuation of the ledge plates 480. As best shown in FIG. 8, each pan element 420 of the discharge pan section 480 includes a short rail 508 forming a rearward continuation of the associated rail 472 and a short vertical wall 510 forming a rearward continuation of the associated vertical wall 476. Each pan element 420 is cut off inwardly of the vertical wall 510 to provide pivotal clearance, however, a short ledge plate 512 is fixed to the upper edge of each vertical wall 510 to for a rearward continuation of the associated ledge plate 480. Pivot plates 436 are welded to the ledge plates 512.

The rearward end portion of the endless assembly defined by the chain links 456 and conveyor flights 454 which moves around the discharge pan section 380 is framed about a drive sprocket wheel 514 3ournaled on the upper end portion of the vertical shaft 316, as by bearings 516. The drive sprocket wheel 514 is formed with a series of openings 518 to permit cut coal to pass vertically therethrough.

Referring now more particularly to FIGS. 6 and 7, there is shown therein a preferred means for driving the drive sprocket wheel 514. As shown, such means comprises a hydraulic motor 520 mounted within the forward central portion of the yoke structure 322. As shown appropriate hydraulic lines are extended to the hydraulic motor 520 through yoke opening 346. The motor itself extends upwardly through yoke opening 348 and has an upwardly extending drive shaft 522 to which a small sprocket wheel 524 is suitably fixed. As best shown in FIG. 6, a drive chain 526 is trained about the motor sprocket wheel 524 and a small idler sprocket wheel 528. As best shown in FIGS. 19, 20, 21, and 23, idler sprocket wheel 528 is fixed to a shaft 530 which is suitably journaled in a sleeve 532 welded to the adjacent forward edge of the top plate 330 of the yoke structure 322. The position of the motor sprocket wheel 524 and idler sprocket wheel 528 is such that when the chain 526 is trained thereabout the rearward run of the chain also meshes with at least three teeth of the drive sprocket wheel 514. With this drive arrangement, the pivotal movement of the movable frame structure 22 and gathering conveyor assembly 26 about the axis of the main vertical shaft 316 is accommodated.

The movable frame structure 22 includes in addition to the horizontally swingable yoke structure 22, a vertical swingable arm structure, generally indicated at 534. As best shown in FIGS. *4a*, *5a*, 8, 23, 25, 31 and 32, the arm structure 534 includes a pair of outwardly forwardly diverging arms 536, each being formed as a weldment from a series of plates. The rearward end of each arm 536 has a transversely extending sleeve 538 forming a part of the weldment thereof. The sleeves 538 are mounted on the ends of the shaft 410 so as to connect the arm structure 534 to the yoke structure 322 for horizontal swinging movement therewith about the axis of the vertical shaft 316 and for vertical swinging movement with respect to the yoke structure about the axis of the shaft 410. The arms 536 are rigidly interconnected by a cross-brace 540 which constitutes an integral part of the weldment of the arm structure 534. As best shown in FIG. 25, the cross-brace 540 is generally triangular in cross-sectional configuration and its connection with each of the arms 536 is strengthened, as by a gusset plate 542, as shown in FIG. 23.

As best shown in FIG. 25, any suitable means may be provided for effecting the vertical swinging movements of the arm structure 534. As shown, the movements are accomplished by a pair of hydraulic piston and cylinder units 544. While it is within the contemplation of the present invention to connect the hydraulic piston and cylinder units 544 between the yoke structure 322 and the mounting arm structure 534, the units 544 are preferably connected between the U-shaped pan section 378 of the gathering conveyor assembly 26 and the arm structure 534. As shown, each piston and cylinder unit 544 has its cylinder end pivoted to a pivot pin 546 extending laterally inwardly into the associated sleeve 408. The piston end of each unit 544 is pivotally connected, as indicated at 548, to the associated arm 536. In this regard it will be understood that each are weldment is formed with a socket-like portion for receiving the piston rod end of the unit 544 and that there is a recess in the bottom portion of each arm weldment to accomodate the upper portion of the cylinder of the unit 544.

Each arm weldment also includes a forward sleeve 550. Fixed within each sleeve 550 is one end of a stub shaft 552. Each of the stub shafts 552 extend laterally inwardly and pivotally receivesa cutter support structure, generally indicated at 554. The support structure 554, like the yoke structure 322 and arm structure 534 is a weldment made up by welding a multiplicity of plates in interconnected relation. As best shown in FIG. 32, the support structure 554 is essentially in the form of a compartmented box, the essential components of which include a rear plate 556, a central partition plate 558 extending forwardly therefrom, an intermediate partition plate 560 on each side of the central partition plate 552 and disposed in parallel relation thereto. Each of the partition plates 560 defines with the central partition plate 558 a compartment within which is mounted a drive motor 562.

Each drive motor 562 may be a hydraulic motor, but preferably is an electric motor mounted with its output shaft (not shown) in driving relation to a gear reduction unit 564 mounted in the forward portion of the associated compartment and having a forwardly extending output shaft 566. Each output shaft 566 extends forwardly beyond the adjacent forward side of the support structure 554. Mounted on each output shaft 566 is a sprocket wheel 568 about which an endless chain 570 is trained. Each endless chain 570 is also trained about a second sprocket wheel 572 which is fixedly connected with a cutter shaft 574 disposed laterally outwardly in parallel relation to the associated output shaft 566. Each cutter shaft 574 extends rearwardly from the associated sprocket wheel 572 and is journaled within an adjacent forward bearing assembly 576 and a spaced rearward bearing assembly 578. The forward bearing assembly 576 is carried by a pair of forward plates 580 forming parts of the support structure weldment which extend laterally outwardly from the forward end of the associated partition plate 560. The laterally outward ends of each pair of plates 580 are rigidly connected with a side plate 582. The rear end of each side plate 582 has a rear cross plate 590 fixed thereto which extends laterally inwardly and serves to mount the associated rear bearing assembly 578.

The laterally inward end of each rear cross plate 590 is fixed to the central portion of a partition plate 592. Each partition plate 592 has its rearward end fixed to the associated end of the rear plate 556 and its front end fixed to the associated rearward plate 580. Each side plate 582 and adjacent partition plate 592 are apertured to receive the associated stub shaft 552 therethrough in a position above the associated shaft 574. Suitable sleeve bearings 594 serve to journal the support structure 554 for vertical movement about the concentric axis of the two stub shafts 552.

As best shown in FIG. 31, the support structure 554 is preferably moved into this position of vertical adjustment about the common axis of the aligned stub shafts 552 by a pair of hydraulic piston and cylinder units 596. Each of the piston and clyinder units 596 is mounted in the compartment of the support structure 554 defined by an adjacent pair of partition plates 560 and 592. The cylinder end of each unit 596 is pivoted to a pivot pin 598 mounted between the upper rearward corners of the associated plates 560 and 592. The piston rod end of each unit 596 is pivoted to a pin 600 mounted within one bifurcated end of an arm 602. The other end of each arm 602 is fixed to a sleeve 604 which in turn is suitably fixed to the adjacent inner end of the associated stub shaft 552.

The coal cutting mechanism 24 is preferably in the form of a pair of oppositely pitched and oppositely rotated auger cutters 606 and 608 fixed to cutter shafts 574. The construction of each of the two auger cutters 606 and 608 is conventional and each is mounted on one of the shafts 574. Basically, each auger cutter includes a hollow central hub, a pair of helical auger blades fixed to the hub and cutting or digging teeth mounted along the periphery of the blades and at the forward ends thereof.

It can be seen that by extending and retracting the hydraulic units 596, the axis of rotation of the two auger cutters 606 and 608 which are disposed in a common pland can be tilted about the common axis of the stub shafts 552. When the machine 10 is used in low seam coal, the hydraulic units 596 are utilized to maintain the axis of the auger cutters in a generally horizontal plane as the arm structure 534 is swung vertically about the axis of the shaft 410. FIG. 31 shows a typical upper movement in dotted lines. When the machine 10 is to be used in relatively high coal with the arm structure 534 raised to the position shown in dotted lines, the hydraulic piston and cylinder units 596 can be further extended to swing the auger cutters 606 and 608 into a position in which their axes extend vertically as shown in phantom lines in FIG. 31.

Referring now more particularly to FIGS. 1-3 of the drawings, there is shown therein views which depict the machine 10 in operation. FIG. 3 illustrates the machine in the position in which it would be moved or trammed from one operating site within a mine to another. The piston and cylinder units 28 are retracted to position the rigid frame structure 12 in its rearwardmost limiting position with respect to the carriage structure 16 supported through the mounting arm assemblies 20 by the endless track units 18. The roof engaging jack assembllies 30 carried by each of the endless track units 18 are retracted, the floor to roof jack mechanisms 32 are likewise retracted, the roof bolt installing mechanism 34 are retracted and raised off of the floor and disposed in their inward positions. The movable frame structure 22 is adjusted horizontally to extend forwardly and vertically to maintain the gathering conveyor assembly 26 and the coal cutting and conveying mechanisms 24 off of the floor. In this contition, the weight distribution forwardly and rearwardly of the endless track units 18 is generally balanced so that by operating the endless track units 18 the entire machine 10 can be moved along the floor without any of the components of the machine which contact the floor in operation in contact therewith.

When it is desired to utilize the machine 10 in an operating mode to remove coal from a typical low seam mine, the machine is trammed up to the working face. The first operation in a typical cycle would be to sump the two auger cutters longitudinally into the seam, preferably at a position where the upper periphery of the auger cutters will define the roof. To accomplish this adjustment, hydraulic piston and cylinder unit 412 is actuated to position the U-shaped pan section 378 of the gathering conveyor assembly 26 near the floor and hydraulic piston and cylinder units 544 are actuated to swing the arm structure 534 vertically about the horizontal shaft 410. In conjunction with this movement hydraulic piston and cylinder units 596 are actuated to maintain the support structure 554 in a generally horizontal position so that the axes of the auger cutters 606 and 608 are likewise generally horizontal. The amount of vertical movement will depend upon the height of the seam, but generally the upper periphery will be brought into a position near or touching the mine roof adjacent the face. The auger motors 52 are then energized and the reversible hydraulic motor 520 is actuated to operate the gathering conveyor 26 so that the flights 554 thereof move in a counter-clockwise direction, as viewed in FIG. 4*a*. Similarly, the main elongated conveyor assembly 14 is actuated so that the flights 38 thereof will be moved rearwardly along the upper pan 40.

With the machine thus conditioned, the generator then actuates the hydraulic piston and cylinder units 28 to extend the same which has the effect of moving the entire machine, except for the carriage structure 16, mounting arms assemblies 20 pivoted thereto and endless track units 18. During this movement, the balanced weight condition tends to switch to a condition in which there is an overbalance at the forward end of the machine. Consequently, roof jack mechanisms 30 preferably are actuated to engage the roof so as to prevent the endless track units 18 and the carriage structure 16 supported thereon from tipping downwardly at their forward ends. The engagement of the roof jack mechanisms 30 with the roof also serves to provide temporary roof support at the areas of engagement. In this regard preferably, the hydraulic circuit for controlling the operation of the jack mechanisms 30 is provided with conventional load locking valves to prevent collapse of the length of the units under induced load. The forward movement also has the effect of advancing or sumping the auger cutters 606 and 608 longitudinally along their axes of rotation into the coal seam, as clearly shown in FIG. 1. A typical sumping depth is approximately four feet.

After the sumping operation has been completed, the floor to roof jack assemblies 32 are extended to anchor the forward end of the rigid frame structure 12 between the floor and roof of the mine. Here again, it is preferable to provide the hydraulic circuit for controlling the operation of the floor to roof jack assemblies 32 with conventional load locking valves to prevent collapse of the length of the units under induced loads. With the forward end of the rigid frame structure 12 thus anchored, the gathering conveyor assembly 26 and auger cutters 606 and 608 are swung horizontally about the axis of the main shaft 316 through another phase of the cycle, and the roof bolt installing mechanisms 34 are simultaneously moved through operating cycles suitable to install four mine roof bolts in the roof.

The first step in the typical horizontal cutting cycle phase is to actuate the hydraulic piston and cylinder units 356 so as to pivot the yoke structure 322 and hence the gathering conveyor assembly 26 and the coal cutting and conveying mechanism 24 therewith in a counter-clockwise direction as viewed in FIG. 4*a*. During this counter-clockwise horizontal swinging movement, the conveyor flights 454 are likewise operated to move in a counter-clockwise direction. A typical arcuate extent of this first step is 45° and FIG. 2 illustrates the position of the augers after the movement has been completed. Preferably, the diameter size of the augers utilized in a typical low seam installation have a diameter size greater than $\frac{2}{3}$ the seam height so that during the movement horizontally in a raised condition the amount of coal left will be less than $\frac{1}{2}$ the diameter of the augers so as to materially aid in clean up as the augers are moved through the second step of the horizontal phase of the cycle after the sump phase.

In this regard, it will be noted, as previously indicated, that the auger cutters 606 and 608 are oppositely pitched and oppositely rotated. The pitch and rotation is such that the augers 607 cut in a direction away from each other and convey in a direction away from one another along their upper peripheries and cut in directions toward one another and convey in directions toward one another along their lower peripheries. In addition, the augers include a rearward conveying component at all times.

When the lead auger cutter 606 has reached the extent of its horizontal movement, which is approximately 45° from the position shown in FIG. 4*a*, hydraulic piston and cylinder units 544 are actuated to lower the arm structure 544 and hydraulic piston and cylinder units 596 are actuated to maintain the augers in a horizontal position. When the auger cutters have been lowered sufficiently to position their lower periphery at the floor level, the motor 520 is reversed to move the gathering conveyor flights 454 in a clockwise direction, as viewed in FIG. 4*a*, and the hydraulic piston and cylinder units 456 are actuated to swing the gathering conveyor 26 and auger cutters 606 and 608 in a clockwise direction about the axis of the vertical shaft 316, as viewed in FIG. 4. When the augers and gathering conveyor have been moved through 45° back to the original position, the auger cutters are again raised so that their upper peripheries are at the roof level, and then the clockwise horizontal swinging movement is continued unitl the opposite limiting position is reached at approximately 45° from the position shown in FIG. 4*a*. Again, the auger cutters are lowered and leveled and then the gathering conveyor assembly is reversed and the auger cutters and gathering conveyor assembly are moved in a counter-clockwise direction back into the original position to complete the horizontal movement phase of the coal cutting cycle.

As previously indicated, during the coal cutting cycle, the roof bolt installing mechanisms 34 are moved through operating cycles so that each facilitates the installation of two roof bolts. Preferably, the first installation is at the inward limiting position of the two roof bolt installing mechanisms 34 since they are in this position during tramming and sumping. Since each roof bolt installing mechanism 34 is operable to install two roof bolts, a description of the operation of one will suffice to give an understanding of the operation of both. Initially, hydraulic piston and cylinder unit 222 is actuated to move the roof bolt installing mechanism 34 downwardly until the bottom plate 218 engages the floor in supported relation. Next stabilizing cylinders 232 are actuated to move the members 236 into roof engagement thus anchoring the entire roof bolt installing mechanism 34 between the floor and roof of the mine at the selected operating position. As with the other temporary roof support cylinders, preferably the hydraulic circuit for the cylinders 232 is provided with a load locking valve. The engagement of members 236 into roof supporting relation by cylinders 232 provides the roof bolter additional temporary roof support supplementing that already provided by the adjacent roof to floor jack mechanism 32. This highly desirable temporary roof support is established from a safe remote position and is present before the bolter moves into close proximity to the rotary mechanism 248 as shown in FIG. 12 to actually operate the same to install the roof bolt.

The first operation of the bolter in the position shown in FIG. 12 is to fit a drill within the rotary mechanism 248 and guide assembly 250 and the latter are raised by operating the elevating mechanisms 254 and 256 in the manner previously indicated. When the rotary mechanism 248 has reached its upper limiting position, a roof bolt hole has been formed in the roof and hence the rotary mechanism 248 is then lowered to permit the operator to replace the drill and guide 250 with a roof bolt which is suitably fitted within the rotary mechanism 248. The rotary mechanism 248 is raised to insert the roof bolt into the drill hole, and when it has been fully raised, the rotary mechanism is actuated to tighten the roof bolt to expand the shell into engagement within the upper end of the hole and tension the head of the bolt against the washer plate engaged with the roof.

The rotary mechanism 248 is then dsengaged from the bolt and lowered. Stabilizing piston and cylinder units 230 are then lowered and the entire roof bolt installing mechanism 34 is raised out of ground supporting relation by actuating the hydraulic piston and cylinder unit 242. Hydraulic piston and cylinder unit 212 is then actuated to swing the arm 202 and the roof bolt installing mechanism 34 carried thereby into its other outer operating position. In this position the same drilling and roof bolt installing procedures are repeated and then the roof bolt installing mechanism 34 is moved back into its inner operating position and moved into a condition out of floor supported relation preparatory to the next sumping operation.

To prepare the machine for the next sumping operation, roof jack mechanisms 30 are lowered and the hydraulic piston and cylinder units 28 are moved into a neutral position. The endless track units 18 can now be actuated to move the carriage structure 16 connected therewith through the mounting arm assemblies 20 forwardly back into a relative position comparable to the position shown in FIG. 3 After the endless track units 18 have been advanced to their forward limiting position, the floor to roof jack mechanisms 32 are lowered to place the components of the machine in the condition previously described to start a sumping operation.

A significant feature of the present invention is the capability of the machine to operate not only in low seam mines, but in relatively high seam mines as well. The operating cycle previously described can be utilized in seams up to four and one half feet by utilizing auger cutters having a diameter size of 36 inches. It is contemplated that auger sizes of 42" and 48" may be utilized in which case their overall length would be reduced such that the sumping depth would be two feet rather than four feet. When auger cutters of this size are utilized, only two roof bolts would be installed during each coal cutting cycle.

It is within the contemplation of the present invention to utilize 36" augers in seams above four and one half feet up to six feet and higher, but a simple sump in swing over to one side and then swing back to center procedure cannot be used very effectively because of the lack of good clean up on the swing back to center in coal higher than one half the diameter. One manner of proceeding in this higher coal would be to sump in at center, swing over to one side along the roof, drop down a distance equal to one half the auger diameter and swing back to center, then drop down to the floor and again swing over to the one side. The last swing back to center can then be used to insure good clean up. Of course the same procedure is then carried out on the other side. Another method of proceeding would be to sump in at the center along the floor and raise the augers to the roof. Next move along the roof toward one side a distance equal to the diameters of both augers plus the space between and then come down to the floor leaving a core between the augers. Next, the augers are raised to the roof without cutting and again moved along the roof toward the one end, this time a distance equal to the spacing between the augers. Next, the augers are moved down to the floor during which the trailing auger cuts the core. The raise up, move along the roof and come down steps are repeated, first moving a distance equal to the spacing between augers plus two diameters and then only a distance equal to the spacing until the full extent of the swing over is reached at which point the augers are moved back to center along the floor.

Where seams are encountered of a height above six or seven feet, the upper portion of the seam is cut by pivoting the auger cutters about the common axis of the stub shafts 522 through the operation of the piston and cylinder unit 596. Preferably, the cutting is accomplished during the upward swing and the augers are returned to a horizontal position before swinging the same horizontally to another position of upward swinging movement. It is of course possible to cut on the way down by combining the vertical swinging movement with the horizontal swinging movement. It will also be understood that the operating height of the machine can be adjusted by adjusting the vertical position of the mounting arm assemblies 20 through operation of the hydraulic piston and cylinder units 112.

The machine is particularly adaptable to mining in seams which are undulating in that the forward components of the machine are swingable vertically about the horizontal shaft 410 while the rearward conveyors 46 and 48 are swingable vertically about pivots 54. The central portion of the machine is stabilized against sliding in any direction on a pitched floor by virtue of the roof jack mechanisms 30 and floor to roof jack mechanisms 32. In the normal operation of the machine one or the other pair of these mechanisms will be in anchoring relation. The machine is also capable of turning corners and in this regard the horizontal swinging movement of the forward components about the vertical axis of shaft 316 is desirable. Similarly, the rear main conveyor component is swingable horizontally about a vertical pivot 64. Where the pitch is side to side, the independent adjustment provided by separate mounting arm assemblies 20 for each endless track unit 18 provides the capability of accommodating side to side undulations. The utilization of the gathering conveyor 26 is particularly desirable since it is open at the top and that the front and the sides therefore have significant capacity. Moreover, it cooperates with the auger cutters are utilizes the shortest possible conveying path due to the reversibility of the movement of the flights.

The manner in which the two auger cutters are mounted in the preferred embodiment thus far described is to be distinguished from the manner in which the dual augers are mounted in prior art dual auger machines, as for example, commonly assigned U.S. Pat. No. 4,341,424. In the patented machine each auger cutter is mounted in a support frame for pivotal movement about an axis parallel to the axis of rotation. The support structure is, in turn, mounted for horizontal swinging movement about a vertical axis. In contrast, the augers of the present invention are mounted in the support structure with their axes in fixed relation and the support structure is not only swingable horizontally about a vertical axis, but is capable of being swung vertically with the mounting arm structure about a transverse horizontal axis and of being tilted about a horizontal transverse axis.

With the prior art arrangement, horizontal swinging movement can take place with the lead auger up and the trailing auger down. However, operation of the augers at the same horizontal level is preferable from the standpoint of simplicity and slightly enhances the time of the cycle and the clean-up characteristics thereof. Nevertheless, it is within the contemplation of the present invention to provide for independent vertical movement of each auger cutter so that in low seam operation horizontal cutting proceeds, if desired, with the lead auger up and the trailing auger down. In this case, however, it is to be noted that all of the other features of the present invention are retained except for mounting simplicity.

Referring now more particularly to FIG. 33 wherein such a modification is illustrated, it will be noted that the support structure 554 previously described is modified to eliminate the forward plates 580 on each side thereof. In addition, rather than mounting the motors 562 and gear reduction units 564 within the compartments defined by the bartition members 560 and 558, each motor 562 and gear reduction unit 564 set is mounted within a separate cylindrical housing forming a part of a pivoted housing assembly, generally indicated at 610.

Each housing assembly 610 includes a cylindrical housing member 612 within which motor 562 and associated gear reduction unit 564 are mounted. The rear end of the cylindrical housing member 612 includes an enclosure wall 614 having a suitable shaft 616 extending rearwardly from the central portion thereof which is suitably journaled in the rear plate 556, as by a sleeve bearing 618. The forward end of each cylindrical housing member 612 has an end ring 620 welded thereto which, in turn, has a mounting ring 622 fixedly secured thereto and extending forwardly through the forward wall of the support structure 554. Each mounting ring 622 interiorly supports the adjacent portion of the associated speed reduction unit 564 and is suitably journaled exteriorly within the adjacent portion of the support structure 554, as by a sleeve bearing 624. Fixed to the forward sleeve of each mounting ring 622 is a rearward wall 626 of an exterior housing portion of the housing assembly 610.

The interior portion of each housing assembly 610 includes a spaced forward wall 628, the walls 626 and 628 being shaped to embrace the associated sprocket wheels 568 and 572 and the chain 570 trained thereabout. The front and rear walls 626 and 628 of each housing assembly 610 are rigidly held in spaced relation by a peripheral wall 630. Each rearward wall 628 is apertured to receive a rearward bearing assembly 632, and a forward bearing assembly 634 is suitably carried in the forward wall 628 in alignment therewith to rotatably support the associated auger cutter and its shaft 574. Extending rearwardly in a position below each rearward bearing assembly 632 is an arm structure 636. The inner end of each arm structure 636 is fixed within the housing structure 610 as by a series of bracing plates 638. Each arm structure 636 extends rearwardly, and the adjacent lower portions of the support structure 554 are relieved to allow the arm structure 636 to pass upwardly therein.

It can thus be seen that each housing structure 610 serves to mount the associated auger cutter for vertical swinging movement about the axis of the cylindrical housing member 612. The associated structure 636 and a piston and cylinder unit 640 are used to effect this vertical movement. The cylinder end of each piston and cylinder unit 640 is connected with the rearward end of the associated arm structure 636, while the piston rod end is connected with a cross brace 642 suitably welded in the associated portion of the support structure 554. In this way, when it is desired to operate with the leading auger up and the trailing auger down, the vertical position of the leader auger is determined by elevating the support structure 554 with the leading auger in its uppermost position as before and the trailing auger is moved downwardly with respect thereto by actuating the associated hydraulic piston and cylinder unit 604.

While it is preferred to utilize a coal cutting and conveying mechanism 24, which comprises a pair of parallel auger cutters, it is within the contemplation of the present invention to utilize a coal cutting and conveying mechanism of the auger type in which all of the auger elements are mounted for rotation about the same horizontal axis. Examples of a cutter of this type are found in U.S. Pat. Nos. 3,044,753 and 226.476.

As schematically illustrated in FIG. 34, an exemplary embodiment of such an arrangement involves the replacement of the pivoted support structure 554 with a fixed support structure 644. A transversely extending auger cutter assembly 646 is mounted in forwardly extending relation thereto by a pair of transversely spaced mounting, driving and cutting assemblies 648. In accordance with known practice, assemblies 648 serve to rotatably support the auger cutter assembly 646 on the support structure 644 in forwardly disposed relation, and to drive the auger cutter assembly 646 rotationally as by chains having coal cutting teeth thereon.

FIG. 35 illustrates the cutting profiles which the auger cutter assembly 646 makes in two successive sumps moving to the left as shown during the horizontal movement to the left. Similar cutting profiles would be developed during the horizontal swing to the right.

It can thus be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A power operated endless track assembly for use in transporting underground mining equipment comprising a pair of separate transversely spaced parallel power driven endless track units, each of said endless track units including an endless track frame carrying forward and rearward sprocket wheels thereon and an endless track extending around said frame and said forward and rearward sprocket wheels, a carriage structure between said pair of endless track units, a generally horizontally disposed mounting arm assembly extending transversely outwardly from each side of said carriage structure to the associated endless track unit, each mounting arm assembly including a pair of transversely outwardly extending forward and rearward mounting arms, means connecting each pair of mounting arms with the endless track frame of the associated endless track unit for pivotal movement about a longitudinally extending generally horizontal axis disposed within a vertical plane passing through the width of the associated endless track so that said endless track units are capable of independent pivotal movements with respect to one another to allow the endless tracks thereof to engagingly by conform to transversely sloping surface areas in the mine floor, means connecting each mounting arm assembly with said carriage structure for pivotal movement about an axis parallel with the axis of pivotal movement between the pair of arms thereof and the associated endless track frame, and hydraulic ram means between said carriage structure and each mounting arm assembly for effecting pivotal movements thereof about its axis of pivotal movement with respect to said carriage structure so that the vertical position of the carriage structure with respect to the positions of engagement of the endless tracks of the endless track units with the mine floor can be varied to accommodate the height of the mine roof.

2. A power operated endless track assembly as defined in claim 1 wherein the pivotal axes of said mounting arm assemblies with said carriage structure are spaced apart adjacent opposite sides of said carriage structure.

3. A power operated endless track assembly as defined in claim 1 wherein the longitudinal pivotal axis between each pair of mounting arms and the associated endless track frame is disposed centrally with respect to the width of the associated endless track at a position substantially closer to the lower run thereof than the upper run thereof.

* * * * *